US009808080B2

(12) United States Patent
Chung

(10) Patent No.: US 9,808,080 B2
(45) Date of Patent: Nov. 7, 2017

(54) PORTABLE HEIGHT-ADJUSTABLE TABLETOP ASSEMBLY AND METHOD OF ADJUSTING A HEIGHT OF THE SAME

(71) Applicant: Timothy Hing-Yan Chung, Mississauga (CA)

(72) Inventor: Timothy Hing-Yan Chung, Mississauga (CA)

(73) Assignee: KINDER DESIGN INC., Mississauga (CA)

( * ) Notice: Subject to any disclaimer, the term of this patent is extended or adjusted under 35 U.S.C. 154(b) by 0 days.

(21) Appl. No.: 15/085,132

(22) Filed: Mar. 30, 2016

(65) Prior Publication Data

US 2016/0286951 A1 Oct. 6, 2016

Related U.S. Application Data

(60) Provisional application No. 62/141,621, filed on Apr. 1, 2015.

(51) Int. Cl.

| | |
|---|---|
| ***A47B 3/02*** | (2006.01) |
| ***A47B 9/16*** | (2006.01) |
| *A47B 9/18* | (2006.01) |

(52) U.S. Cl.

CPC ..... *A47B 9/16* (2013.01); *A47B 3/02* (2013.01); *A47B 9/18* (2013.01); *A47B 2003/025* (2013.01)

(58) Field of Classification Search

CPC ..... A47B 9/16; A47B 3/02; A47B 2003/045; A47B 2003/025; D06F 81/04

USPC ..... 108/116, 117, 118, 119, 120

See application file for complete search history.

(56) References Cited

U.S. PATENT DOCUMENTS

| | | | | |
|---|---|---|---|---|
| 200,057 | A * | 2/1878 | Hart | A47B 9/16 108/116 |
| 1,846,607 | A * | 2/1932 | Nicholas | A47C 3/38 108/120 |
| 2,692,807 | A * | 10/1954 | Cordola | A47B 3/02 108/120 |
| 2,829,936 | A * | 4/1958 | Anderson | A47B 9/16 108/117 |

(Continued)

FOREIGN PATENT DOCUMENTS

| | | |
|---|---|---|
| EP | 1914193 | 1/2010 |

OTHER PUBLICATIONS

Varidesk, "The Height-Adjustable Standing Desk". Retrieved from Internet on Mar. 30, 2016: http://uk.varidesk.com/laptop-standing-desk-VARIDESK-for-laptop.

*Primary Examiner* — Jose V Chen

(74) *Attorney, Agent, or Firm* — Bereskin & Parr LLP

(57) ABSTRACT

A portable tabletop assembly includes a horizontal tabletop, first and second pairs of legs for supporting the tabletop on a horizontal surface, a first crossbeam, and a height lock. Each pair of legs includes a first leg and a second leg pivotably connected to one another. Each leg has a first leg end, and a second leg end slidably coupled to the tabletop. The first crossbeam connects the first leg of the first pair of legs to the first leg of the second pair of legs. The height lock is engageable at infinite positions between raised and storage positions to inhibit horizontal sliding of the first crossbeam and the second leg ends of the first legs to fix a height of the tabletop above the horizontal surface. A method of adjusting the height of a portable tabletop assembly is also disclosed.

13 Claims, 31 Drawing Sheets

(56) References Cited

U.S. PATENT DOCUMENTS

| | | | | | |
|---|---|---|---|---|---|
| 3,152,833 | A * | 10/1964 | Creveling | A47B 3/14 | 108/117 |
| 3,174,443 | A * | 3/1965 | Rothenbuhler | A47B 3/02 | 108/117 |
| 3,329,104 | A * | 7/1967 | Gittings | A47B 3/02 | 108/117 |
| 3,727,245 | A * | 4/1973 | Gerth | A47C 17/134 | 280/641 |
| 3,823,915 | A | 7/1974 | Koehler | | |
| 4,433,869 | A * | 2/1984 | Payne, Jr. | A47D 13/043 | 108/119 |
| 5,199,930 | A * | 4/1993 | Weber | A63K 3/043 | 108/117 |
| 5,324,064 | A | 6/1994 | Sumser et al. | | |
| 6,182,935 | B1 * | 2/2001 | Talesky | B23D 47/025 | 108/118 |
| 6,974,185 | B2 * | 12/2005 | Hsieh | A47C 3/36 | 108/117 |
| 9,289,058 | B2 | 3/2016 | Flaherty | | |
| 2015/0250303 | A1 | 9/2015 | Flaherty | | |

* cited by examiner

PORTABLE HEIGHT-ADJUSTABLE TABLETOP ASSEMBLY AND METHOD OF ADJUSTING A HEIGHT OF THE SAME

FIELD

This disclosure relates to the field of portable height-adjustable tabletop assemblies and to methods of adjusting the same.

INTRODUCTION

Public awareness of ergonomics and its importance to personal health has seen a rise in demand for ergonomic desks. Recently, ergonomic desks have been introduced which include a height adjustable tabletop and motor driven supports for raising and lowering the tabletop at the press of a button. These desks allow a user to periodically adjust the height of the tabletop for sitting or standing working postures.

SUMMARY

In a first aspect, a portable tabletop assembly is provided. The tabletop assembly may include a horizontal tabletop, first and second pairs of legs, a first crossbeam, and a height lock. The first and second pairs of legs may support the tabletop on a horizontal surface. Each pair of legs may include a first leg and a second leg pivotably connected to one another. Each of the first and second legs of each pair may have a first leg end, and a second leg end slidably coupled to the tabletop. The first crossbeam may connect the first leg of the first pair of legs to the first leg of the second pair of legs. The first crossbeam and the second leg ends of the first legs of the first and second pairs may be slidable relative to the tabletop and relative to the second leg ends of the second legs of the first and second pairs so that the tabletop moves between a raised position and a storage position. The height lock may be coupled to the first pair of legs. The height lock may be engageable at infinite positions between the raised and storage positions to inhibit horizontal sliding of the first crossbeam and the second leg ends of the first legs of the first and second pairs to fix a height of the tabletop above the horizontal surface.

In another aspect, a portable tabletop assembly is provided in accordance with another embodiment. The portable tabletop assembly may comprise a tabletop, a height-adjustable support structure connected to the tabletop; and a height locking mechanism operably connected to the support structure. The height locking mechanism may have at least one height lock, a height lock-release actuator, a safety, and a safety-release actuator. The height lock, when activated, may engage with the support structure to inhibit height adjustment of the support structure. The height lock-release actuator, when activated, may deactivate the height lock to permit height adjustment of the support structure. The safety, when activated, may inhibit activation of the height lock-release actuator. The safety-release actuator, when activated may deactivate the safety to permit the height lock-release actuator to be activated.

In another aspect, a method of adjusting the height of a portable tabletop assembly is provided. The tabletop assembly may comprise a tabletop and a height-adjustable support structure connected to the tabletop for supporting the tabletop above a horizontal surface. The tabletop may extend laterally between first and second lateral tabletop ends. The method may comprise concurrently grasping the first lateral tabletop end and activating a safety-release actuator to deactivate a safety to a height lock-release actuator; with the safety deactivated, concurrently grasping the second lateral tabletop end and activating the height lock-release actuator to permit height adjustment of the support structure; and adjusting a height of the support structure to a desired height, and then activating the height lock to fix the height of the support structure at the desired height.

In another aspect, a portable tabletop assembly is provided in accordance with another embodiment. The portable tabletop assembly may comprise a tabletop extending in lateral and longitudinal dimensions; first and second pairs of legs for supporting the tabletop on a surface, a crossbar, and a first centering arm. Each pair of legs may include a first leg pivotably connected to a second leg for rotation about a longitudinal axis. Each of the first and second legs may have a first leg end, and a second leg end slidably coupled to the tabletop. The crossbar may have a first end connected to the first pair of legs, and a second end connected to the second pair of legs. The first centering arm may have opposite first and second arm ends. The first arm end may be pivotally connected to the second leg of the first pair between the first and second leg ends of the second leg of the first pair. The second arm end may be pivotally connected to the table top, The first and second arm ends may be both positioned laterally to one side of the crossbar. In each pair, the second leg ends of the first and second legs may be both slidable relative to the tabletop away from each other for pivoting the first leg relative to the second leg to lower the tabletop toward the surface from a raised position into a storage position. In the storage position, the crossbar may abuts the tabletop.

In another aspect, a portable tabletop assembly is provided in accordance with another embodiment. The portable tabletop assembly may comprise a tabletop defining a support surface, a height adjustable support structure coupled to the tabletop for supporting the tabletop, a height lock, a height lock-release actuator, a safety, and a safety-release actuator. The tabletop may have opposite first and second lateral ends. The height lock may be coupled to the height adjustable support structure. The height lock when activated may inhibit height adjustment of the height adjustable support structure. The height lock-release actuator may be coupled to the tabletop. The height lock-release actuator when activated may deactivate the height lock to permit height adjustment of the height adjustable support structure. The safety may be coupled to the tabletop. The safety when activated may inhibit activation of the height-lock release actuator. The safety-release actuator may be coupled to the tabletop. The safety-release actuator when activated may deactivate the safety to permit activation of the height-lock release actuator. The height lock-release actuator may be positioned proximate the first lateral end of the tabletop for manual actuation while grasping the first lateral end, and the safety-release actuator may be positioned proximate the second lateral end of the tabletop for manual actuation while grasping the second lateral end.

DRAWINGS

DESCRIPTION OF VARIOUS EMBODIMENTS

Figure 1:
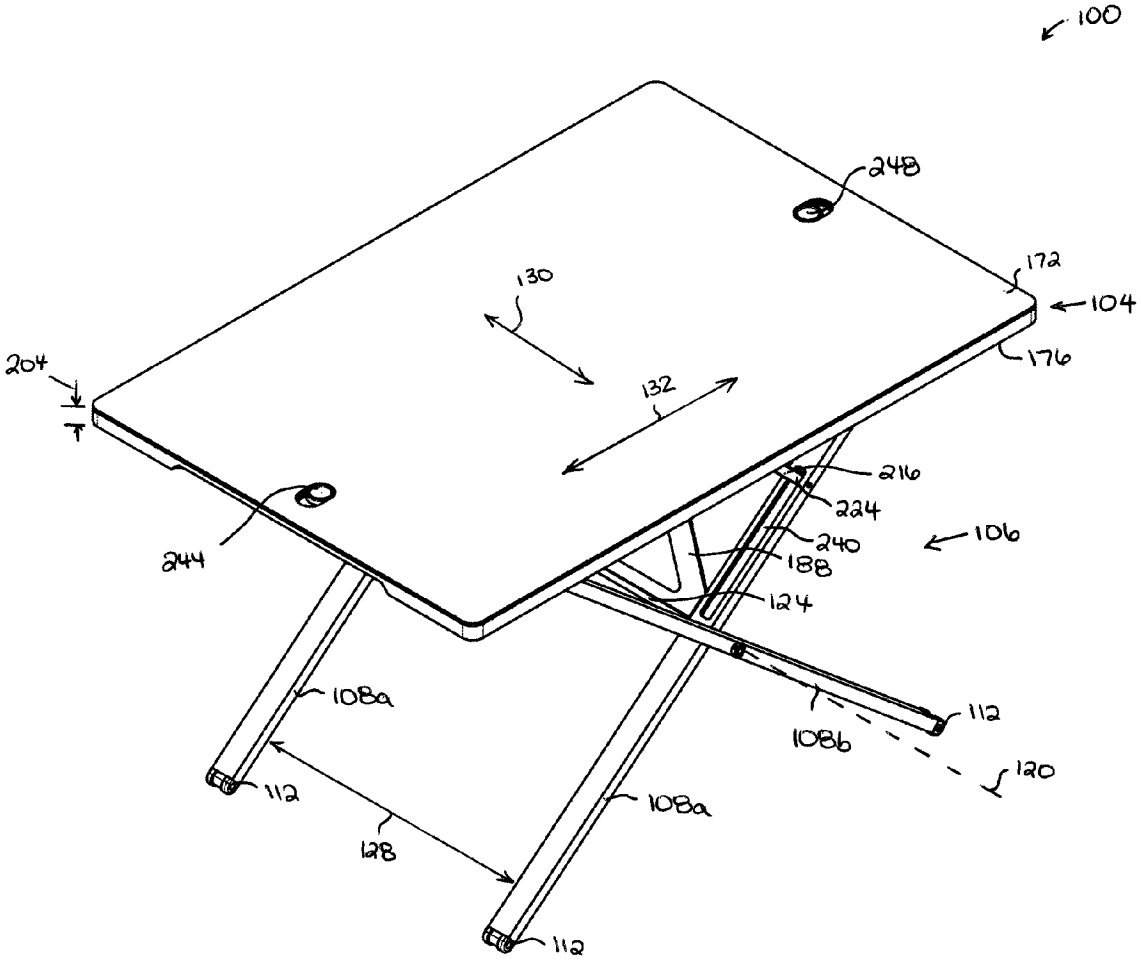
FIG. 1 is a top perspective view of a portable height-adjustable tabletop assembly in a raised position, in accordance with at least one embodiment.

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected directly in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

An office desk which incorporates motor driven supports for raising and lowering the tabletop can be effective for adapting the desk to seated and standing positions. However, cost and portability may make such desks unattainable or infeasible for some users.

FIGS. 1-4 show a portable height-adjustable tabletop assembly 100 in accordance with at least one embodiment. As shown, tabletop assembly 100 may include a tabletop 104 and a height adjustable support structure 106 for supporting tabletop 104 on a horizontal surface. Height adjustable support structure 106 may take any suitable form. In the illustrated embodiment, height adjustable support structure 106 includes a plurality of legs 108 for supporting tabletop 104 on a horizontal surface. For example, tabletop assembly 100 may be positioned on top of an office desk whereby legs 108 may support tabletop 104 above the office desk.

Figure 15B:
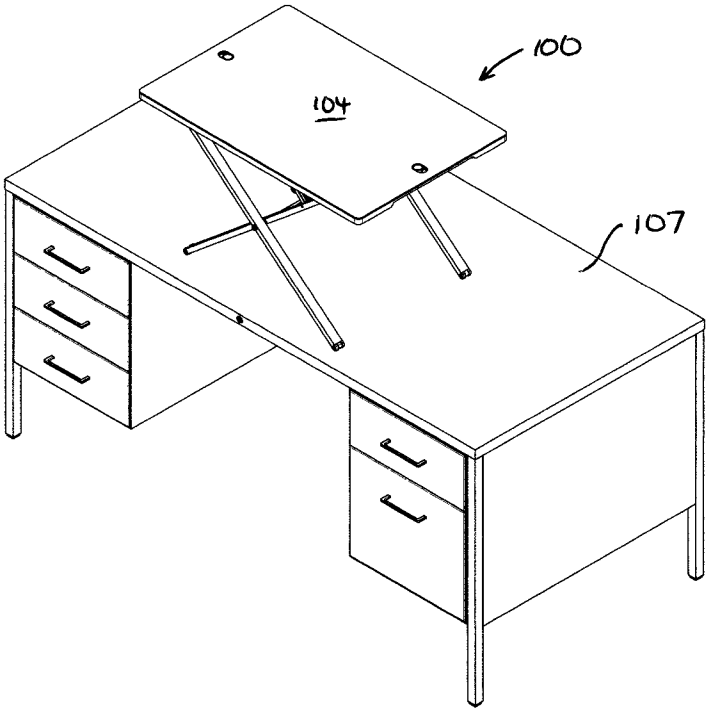
FIG. 15B is a perspective view of the tabletop assembly of FIG. 1 positioned on the desk, in the raised position.
Figure 15A:
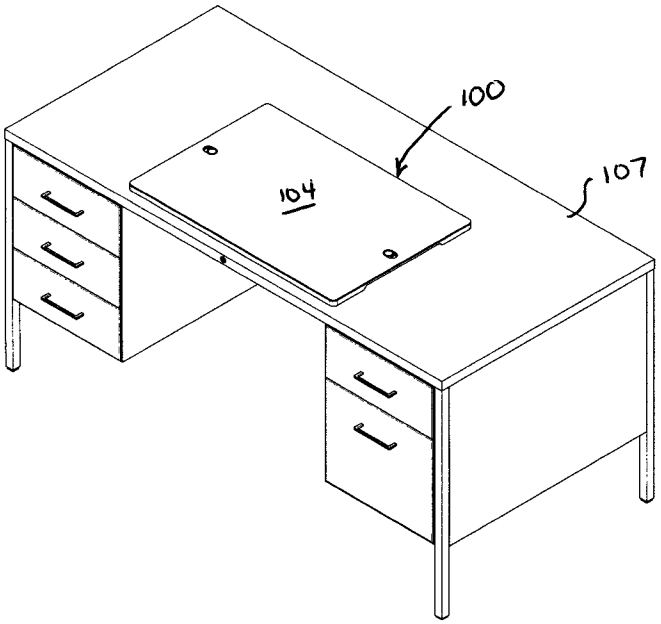
FIG. 15A is a perspective view of the tabletop assembly of FIG. 1 positioned on a desk, in the storage position.
Figure 16B:
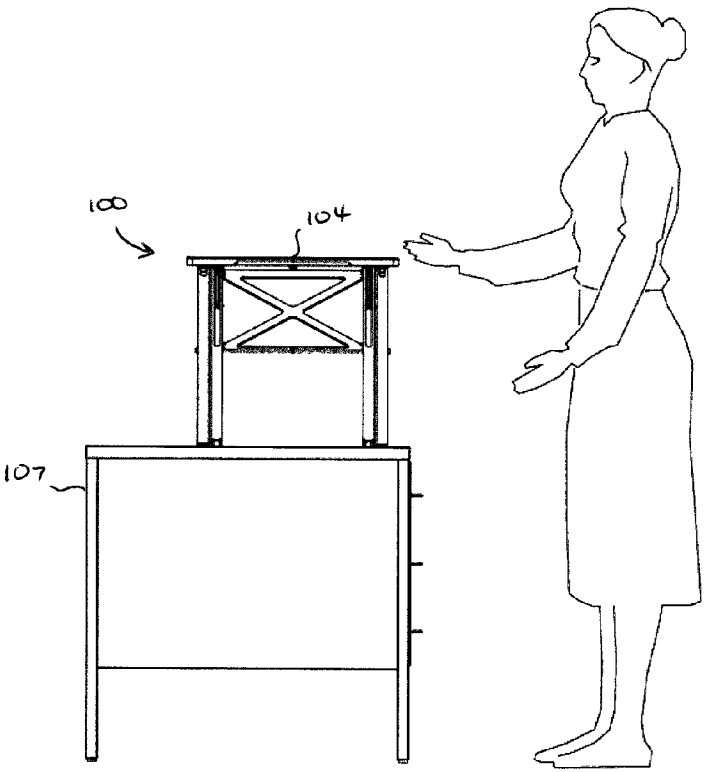
FIG. 16B is a side elevation view of the tabletop assembly of FIG. 1 positioned on the desk, in the storage position, and the user in a standing position.
Figure 16A:
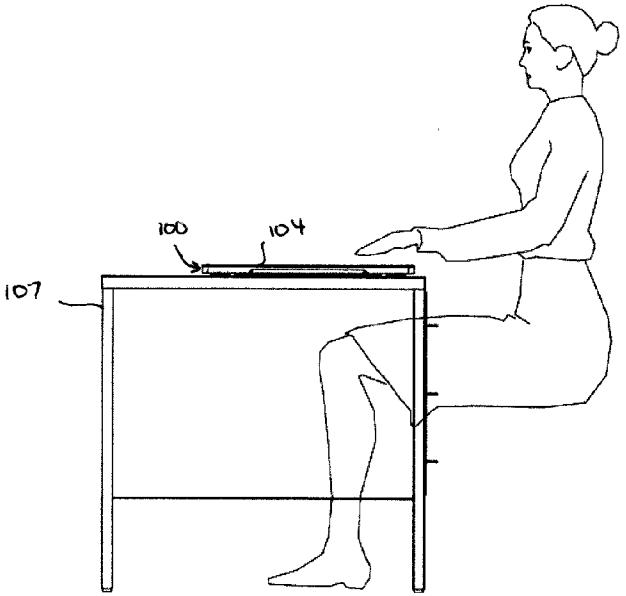
FIG. 16A is a side elevation view of the tabletop assembly of FIG. 1 positioned on the desk, in the storage position, and a user in a seated position.

Referring to FIGS. 15A and 15B, tabletop assembly 100 may be selectively height adjustable to move tabletop 104 between a raised position (FIG. 15B) and a storage position (FIG. 15A). For example, tabletop assembly 100 may be positioned on top of an office desk 107 with a laptop stationed on tabletop 104. In this example, tabletop 104 may be lowered to the storage position to permit a seated user to use the laptop as shown in FIG. 16A, and tabletop 104 may be elevated to the raised position to permit a standing user to use the laptop as shown in FIG. 16B. In this way, tabletop assembly 100 may provide sit-stand functionality to an otherwise static office desk. Further, tabletop assembly 100 may be portable which may permit carrying tabletop assembly 100 between office desks or other horizontal surfaces.

Referring to FIGS. 1-4, as shown, tabletop assembly 100 may include one or more pairs of first and second legs 108*a* and 108*b*. In the illustrated example, tabletop assembly 100 includes two pairs of legs 108. In alternative embodiments, tabletop assembly 100 may include just one pair of legs 108, or more than two pairs of legs 108*a* and 108*b*. In some embodiments, there may be one or more triplets or greater groupings of legs 108. Each leg 108 extends in length from a first leg end 112 to a second leg end 116. As exemplified, each pair of legs 108 may include a first leg 108*a* pivotally connected to a second leg 108*b* for rotation about a leg pivot axis 120. Leg pivot axis 120 may extend through the first and second legs 108 between each leg's first and second leg ends 112 and 116. For example, leg pivot axis 120 may extend through the first and second legs 108*a* and 108*b* at a midpoint between each leg's first and second leg ends 112 and 116 as shown.

Still referring to FIGS. 1-4, first and second legs 108*a* and 108*b* may be pivotally connected in any suitable fashion. For example, first and second legs 108*a* and 108*b* may be pivotally connected by a connecting pin, or a hinge. In the illustrated embodiment, first and second legs 108*a* and 108*b* are shown pivotally connected by a common crossbar 124. As shown, crossbar 124 may extend through openings (obscured from view) in first and second legs 108*a* and 108*b* collinearly with leg pivot axis 120.

In some embodiments, leg pivot axis 120 of each pair of legs 108 may be collinear. As exemplified, legs 108 of both pairs of legs may be pivotally mounted on crossbar 124 for rotation about the same leg pivot axis 120. In some cases, crossbar 124 may help to maintain the longitudinal distance 128 between the pairs of legs 108, which may help to inhibit movement of legs 108 in the longitudinal direction 130 for enhanced lateral stability.

Figure 2:
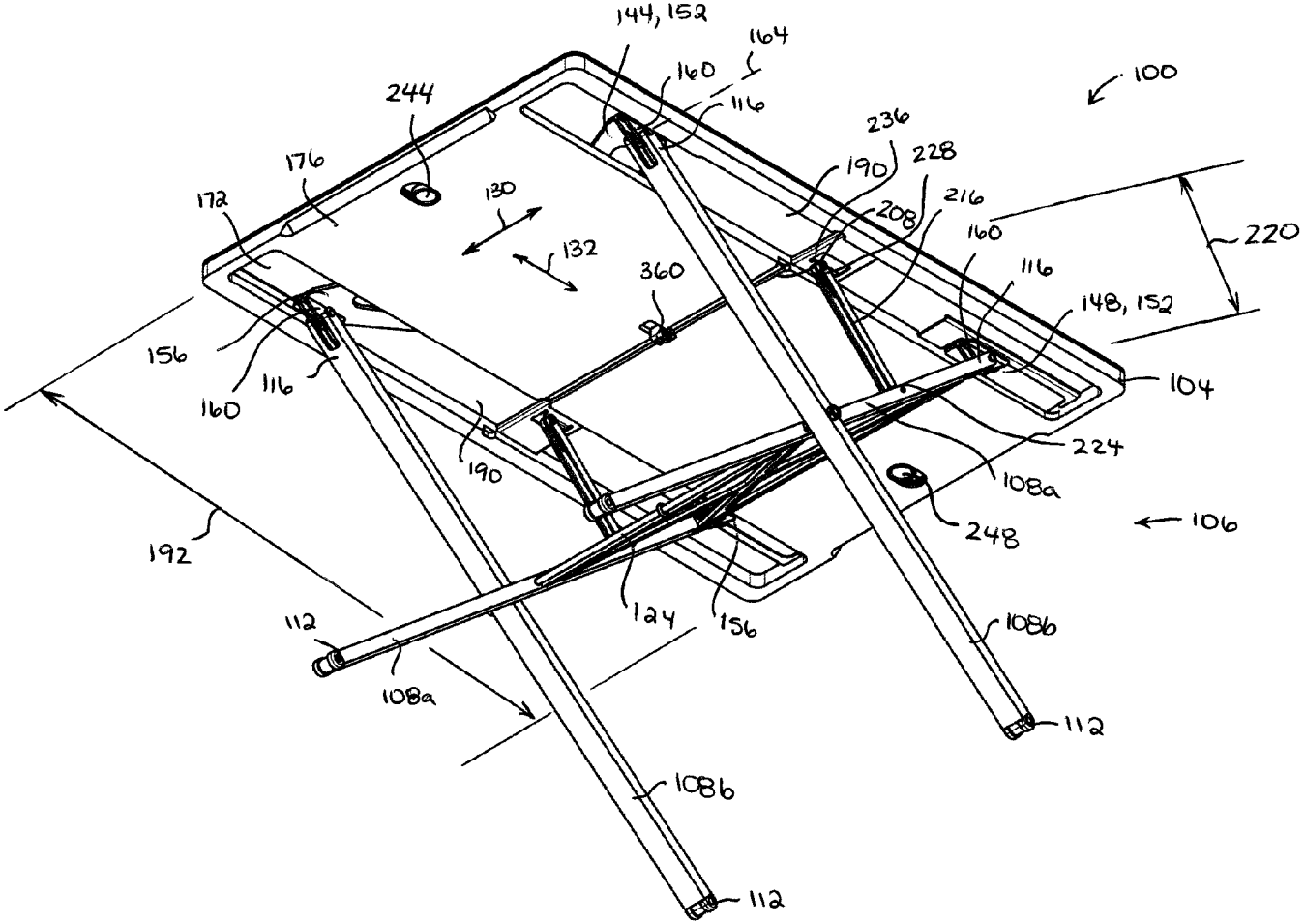
FIGS. 2 and 3 are bottom perspective views of the tabletop assembly of FIG. 1 in the raised position.
Figure 3:
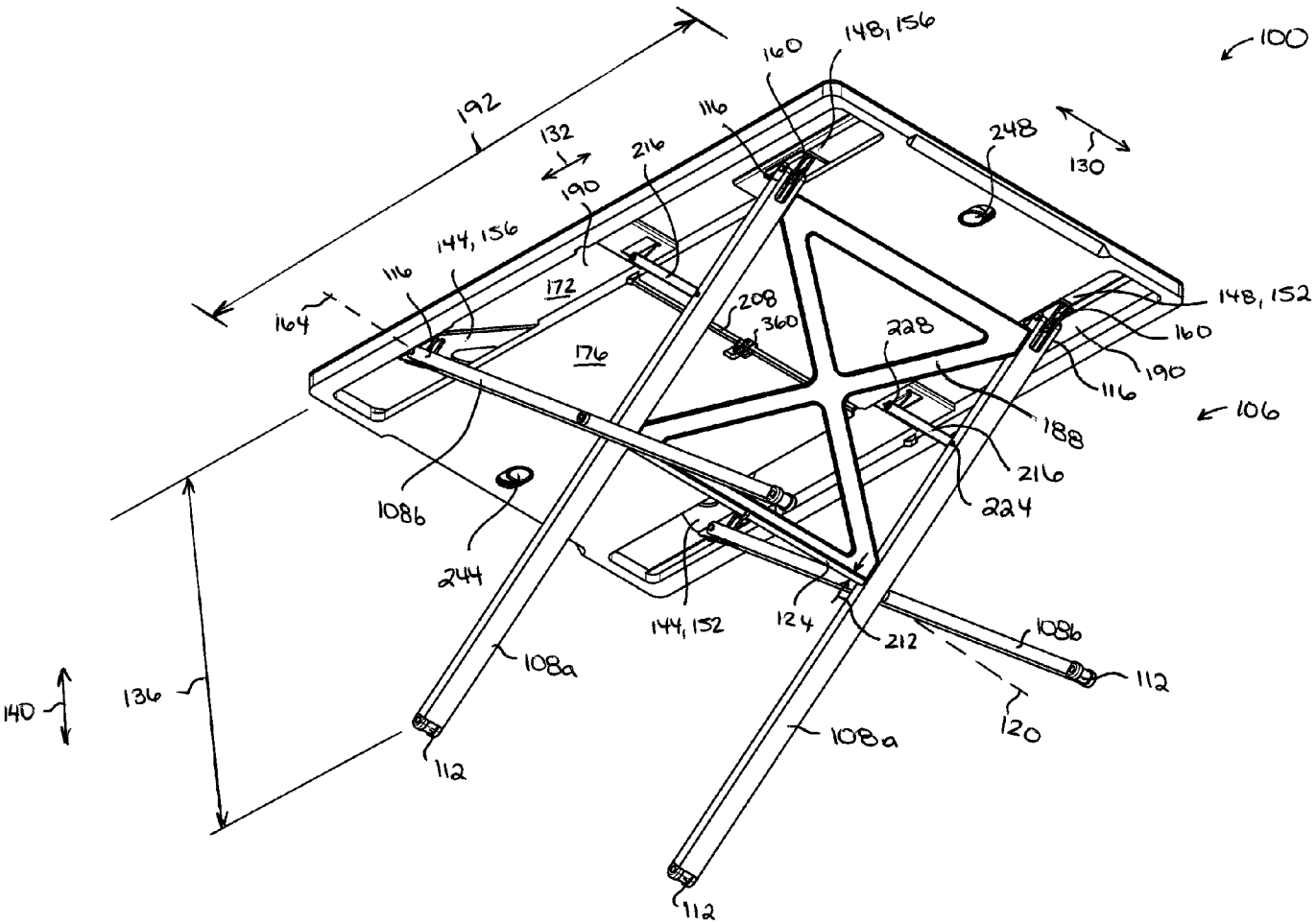
Figure 4:
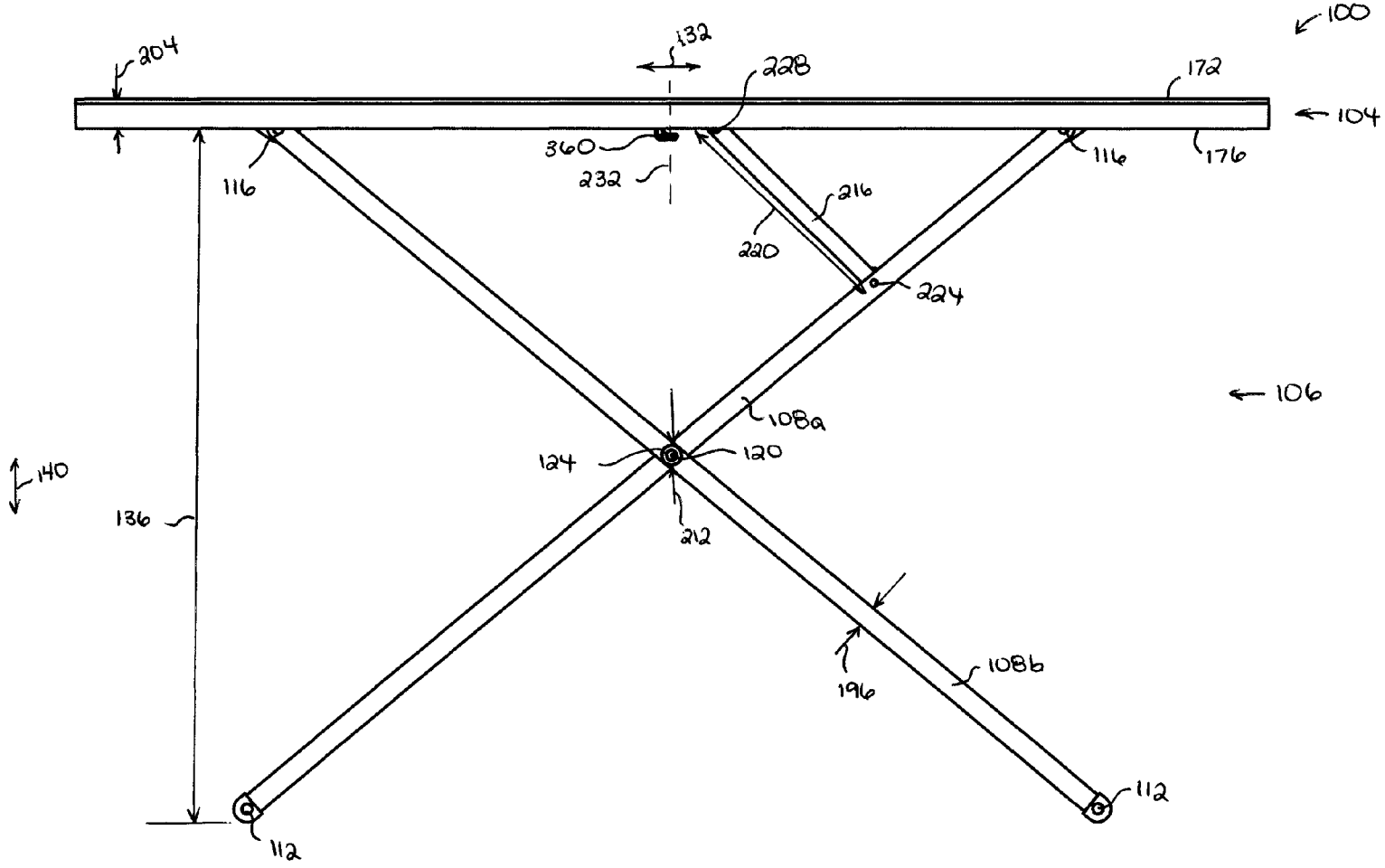
FIG. 4 is a side elevation view of the tabletop assembly of FIG. 1 in the raised position.

Referring to FIGS. 2-4, the second leg end 116 of each leg 108 may be slidably coupled to the tabletop 104. As shown, the second leg end 116 of each leg 108 may be slidable in the lateral direction 132 relative to tabletop 104. In the illustrated example, in each pair of legs 108, the second leg ends 116 of the legs 108*a* and 108*b* are movable along tabletop 104 toward or away from each other as those legs 108*a* and 108*b* pivot about leg pivot axis 120.

Moving second leg ends 116 toward each other by pivoting the legs 108*a* and 108*b* of a pair of legs 108 in opposite directions (e.g. like scissors), increases a height 136 (FIG. 4) of those legs 108*a* and 108*b* measured between the first and second leg ends 112 and 116 in a vertical direction 140 normal to the horizontal surface of the tabletop 104. In so doing, legs 108 may support tabletop 104 at a raised height above a horizontal surface.

Figure 5:
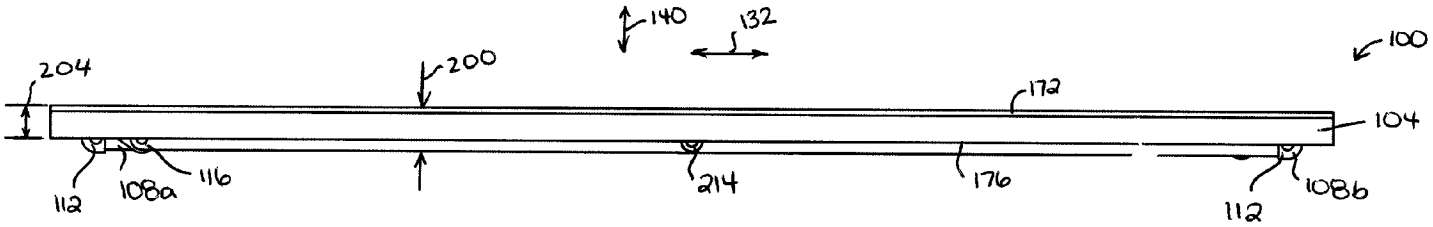
FIG. 5 is a side elevation view of the tabletop assembly of FIG. 1 in a storage position.
Figure 6:
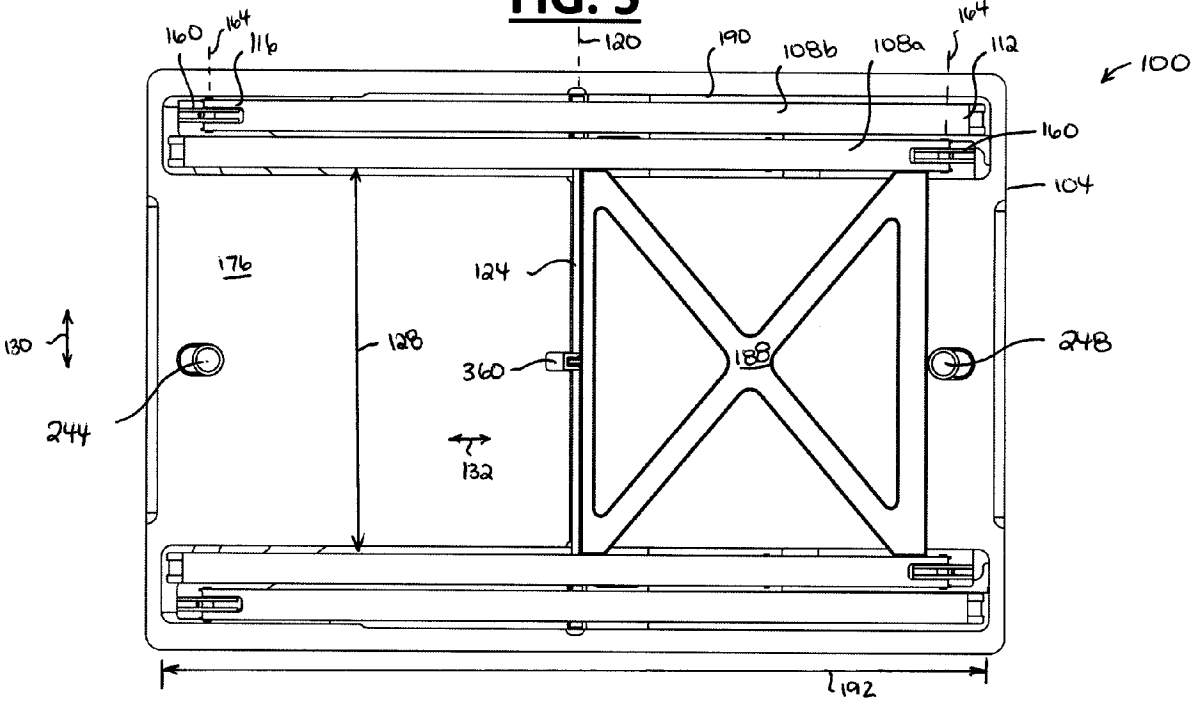
FIG. 6 is a bottom plan view of the tabletop assembly of FIG. 1 in the storage position.

Similarly, moving second leg ends 116 away from each other by pivoting the legs 108*a* and 108*b* of a pair of legs 108 in opposite directions (e.g. like scissors), decreases the height 136 (FIG. 4) of those legs 108*a* and 108*b*. As illustrated in FIGS. 5 and 6, in some embodiments, legs 108*a* and 108*b* may be pivotable in opposite directions until second leg ends 116 are substantially level with first leg ends 112. In this condition, legs 108 may be substantially horizontal as shown. This may provide a compact storage position for tabletop assembly 100 for convenient storage and transportation of tabletop assembly 100.

Turning to FIGS. 2 and 3, the second leg ends 116 of the first legs 108*a* of both pairs of legs 108 may slide in synchronicity along tabletop 104. Similarly, the second leg ends 116 of the second legs 108*b* of both pairs of legs 108 may slide in synchronicity along tabletop 104.

The second leg ends 116 of the first legs 108*a* may be connected together in any suitable manner for synchronous sliding along tabletop 104. Similarly, the second leg ends 116 of the second legs 108*b* may be connected in any suitable manner for synchronous sliding along tabletop 104. In the illustrated embodiment, a first crossbeam 144 connects the second leg ends 116 of the first legs 108*a*, and a second crossbeam 148 connects the second leg ends 116 of the second legs 108*b*. Crossbeams 144 and 148 may be rigid members of any suitable material(s) (e.g. plastic, metal, glass, ceramics, or combinations thereof) which slide along tabletop 104 in synchronicity with the second leg ends 116 they connect.

Still referring to FIGS. 2 and 3, each second leg end 116 may be pivotally connected to a crossbeam 144 or 148 in any suitable fashion. In the illustrated embodiment, each crossbeam 144 and 148 extends from a first crossbeam end 152 to a second crossbeam end 156. A hinge bracket 160 may protrude downwardly from each crossbeam end 152 and 156. Each second leg end 116 may be forked to surround each hinge bracket 160, and each hinge bracket 160 may be pivotally connected to each second leg end 116 by a hinge pin (obscured from view). As shown, the pivotal connection between second leg ends 116 and the hinge bracket 160 may permit each legs 108 to pivot about second leg ends 116 relative to a crossbeam 144 or 148 around at least a second pivot axis 164. Second pivot axis 164 may extend in a longitudinal direction 130 parallel to the horizontal surface of tabletop 104 and perpendicular to lateral direction 132.

Referring to FIG. 2, crossbeams 144 and 148 may be slidable along tabletop 104 in any suitable fashion. In the illustrated embodiment, each crossbeam 144 and 148 is movable inside tabletop 104 between an upper tabletop end 172 and a lower tabletop end 176. As shown, at least a portion of upper and lower tabletop ends 172 and 176 may be spaced apart to define a cavity inside which crossbeams 144 and 148 may be laterally slidable.

Figure 7:
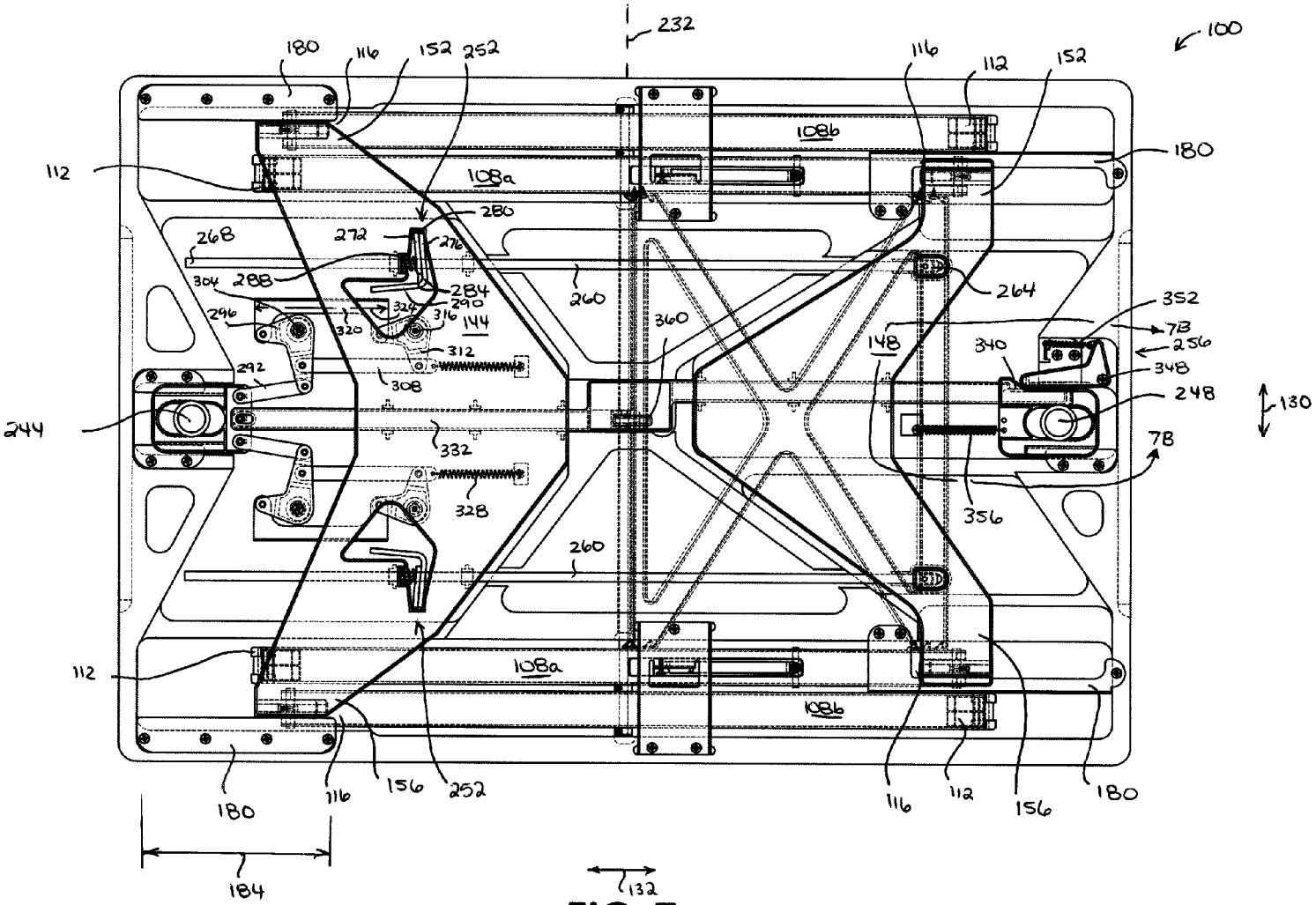
FIG. 7 is a top plan view of the tabletop assembly of FIG. 1, in the raised position, with an upper tabletop end omitted, and with a height lock-release actuator and safety-release actuator deactivated.

Reference is now made to FIG. 7, which shows a top plan view of tabletop assembly 100, in a raised position with upper tabletop end 172 removed for visibility of the interior elements below. In some embodiments, one or both of crossbeams 144 and 148 may be restricted to horizontal lateral sliding relative to tabletop 104 (i.e. inhibited from all other directions of movement and rotation). As shown, tabletop assembly 100 may include guide rails 180 fastened to opposite longitudinal ends of tabletop 104. Each crossbeam end 152 and 156 may be mounted to a respective guide rail 180 for lateral sliding along that respective guide rail.

Figure 10:
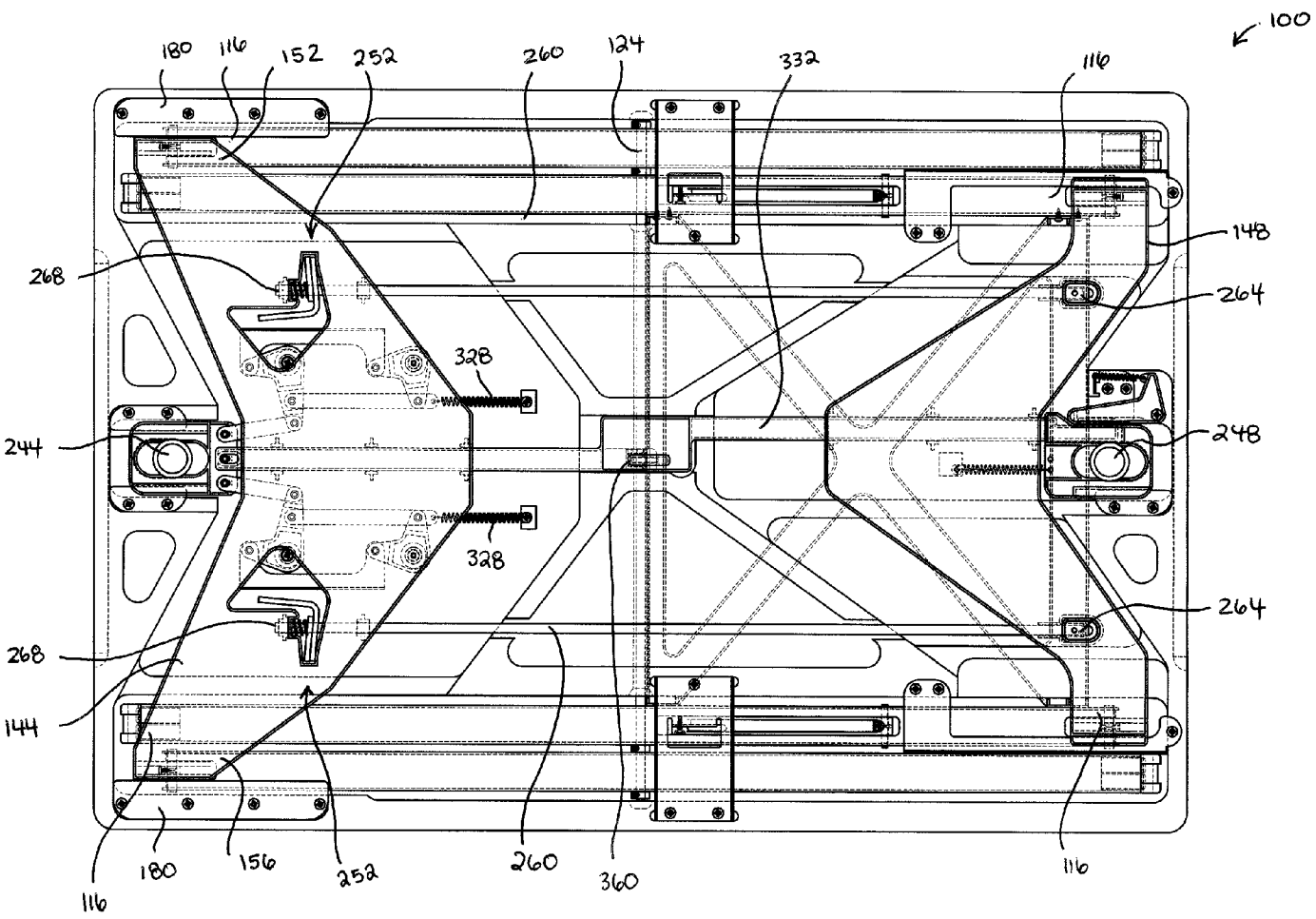
FIG. 10 is a top plan view of the tabletop assembly of FIG. 1, in the storage position, with the upper tabletop end omitted, and with the height lock-release actuator and safety-release actuator deactivated.

As exemplified, each guide rail 180 may have a lateral extent 184 which may define the range of lateral movement for the connected crossbeam end 152 or 156. For example, in FIG. 7, tabletop assembly 100 is in a raised position with crossbeam ends 152 and 156 at their respective innermost lateral positions along guide rails 180. In FIG. 10, tabletop assembly 100 is in a storage position with crossbeam ends 152 and 156 at their respective outermost lateral positions along guide rails 180.

Returning to FIG. 3, in some embodiments tabletop assembly 100 may include a crossbrace 188 for enhanced longitudinal stability. As exemplified, crossbrace 188 may be a rigid member which is rigidly connected to legs 108 of different leg pairs for movement with those legs 108. For example, crossbrace 188 may rigidly connect the second legs 108*a* of the two pairs. In the illustrated example, crossbrace 188 may extend in width from one second leg 108*a* to the other second leg 108*a*, and extend in length from proximate the second leg ends 116 to proximate leg pivot axis 120. Crossbrace 188 may resist longitudinal skewing of legs 108 where tabletop 104 and second leg ends 116 move longitudinal relative to first leg ends 112. Crossbrace 188 may have any suitable shape. For example, crossbrace 188 may have a lattice shape as shown, or alternatively a solid rectangular shape.

In some embodiments, tabletop assembly 100 may have a compact storage position for ease of transportation and storage. Referring to FIG. 3, lower tabletop end 176 may include one or more openings or grooves for receiving at least a portion of legs 108 in the storage position of FIG. 6. In the illustrated embodiment, lower tabletop end 176 includes two openings 190, each opening 190 sized to receive both legs 108*a* and 108*b* of one of the pair of legs 108. As shown in FIG. 6, each opening 190 may have a lateral length 192 equal to or greater than the length of legs 108 (measured from first leg end 112 to second leg end 116). This may permit legs 108 to fit inside openings 190 when oriented substantially horizontally laterally in the storage position.

As shown in FIG. 4, legs 108 may have a leg thickness 196. Turning to FIG. 5, when tabletop assembly 100 is in the storage position, at least a portion of leg thickness 196 across the entire length of legs 108 may be received in tabletop 104. In the illustrated example, for the full length of each leg 108, a portion of leg thickness 196 is received in tabletop 104, and a portion protrudes below tabletop 104. Accordingly, a height 200 of tabletop assembly 100 in the storage position may be less than a sum of the leg thickness 196 of legs 108 and a tabletop thickness 204 of tabletop 104.

Referring to FIG. 2, lower tabletop end 176 may include an opening or groove for receiving at least a portion of crossbar 124 in the storage position of FIG. 6. In the illustrated embodiment, lower tabletop end 176 includes a groove 208 sized to receive at least a portion of crossbar 124 in the storage position. As shown in FIG. 6, groove 208 may have a longitudinal length 212 equal to or greater than that of crossbar 124. In some embodiments, groove 208 may extent continuously or discontinuously across and between openings 190. As shown, groove 208 is positioned to align with crossbar 124 in the storage position.

As shown in FIG. 4, crossbar 124 may have a crossbar thickness 212. Turning to FIG. 5, when tabletop assembly 100 is in the storage position, at least a portion of crossbar thickness 212 across the entire length of crossbar 124 may be received in tabletop 104. In the illustrated example, for the full length of crossbar 124, a portion (obscured from view) of leg crossbar thickness 212 is received in tabletop 104, and a portion 214 protrudes below tabletop 104. Accordingly, tabletop assembly height 200 in the storage position may be less than a sum of the crossbar thickness 212 and tabletop thickness 204.

Referring to FIG. 4, in some embodiments, tabletop assembly 100 may include at least one centering arm 216 for coordinating the simultaneous lateral sliding of the second leg ends 116 of the first and second legs 108*a* and 108*b* of each pair. In the illustrated example, tabletop assembly 100 includes two centering arms 216 (FIG. 2). As shown, centering arm 216 extends in length 220 from a first arm end 224 to a second arm end 228. As shown, first arm end 224 may be pivotally connected to one of legs 108 between the first and second leg ends 112 and 116 of that leg 108. For example, first arm end 224 may be pivotally connected to a leg 108 between the leg pivot axis 120 and second leg end 116 of that leg 108. In the illustrated example, first arm end 224 is pivotally connected to first leg 108*a* at approximately a midpoint between leg pivot axis 120 and second leg end 116 of the leg 108*a*.

Still referring to FIG. 4, second arm end 228 may be pivotally connected to tabletop 104 proximate lateral centerline 232 of tabletop 104. In some embodiments, second arm end 228 may be positioned laterally offset from lateral centerline 232 between lateral centerline 232 and first arm end 224. This may provide clearance for crossbar 124 to be at least partially received in tabletop 104 in the storage position.

Second arm end 228 may be pivotally connected to tabletop 104 in any suitable fashion. Referring to FIG. 2, a hinge bracket 236 may be mounted to an underside of tabletop 104 as shown. Second arm end 228 may be pivotally connected to hinge bracket 236 (e.g. by a hinge pin). In the illustrated example, hinge bracket 236 and second arm end 228 are laterally offset from lateral centerline 232 and groove 208 for crossbar 124.

Reference is now made to FIG. 1. In some embodiments, leg 108 may include a groove 240 for receiving at least a portion of centering arm 216 within the leg thickness 196 of the leg 108, when in the storage position. In other words, centering arm 216 may be at least partially stored inside leg 108 in the storage position. This may enhance the compactness of the storage position of tabletop assembly 100. As shown, first arm end 224 may be pivotally connected to leg 108*a* from inside groove 240 to permit centering arm 216 to fold into leg 108*a* in the storage position.

In some embodiments, tabletop assembly 100 may include a height lock mechanism for selectively locking a height of tabletop assembly 100 at any position between the storage position and the raised position. The height lock mechanism may include at least one height lock, a height lock-release actuator, a safety, and a safety-release actuator. The height lock, when activated, may engage with the tabletop support structure to inhibit height adjustment of the tabletop support structure. The height lock-release actuator, when activated, may deactivate the height lock to permit height adjustment of the tabletop support structure. The safety, when activated, may inhibit activation of the height lock-release actuator. The safety-release actuator, when activated may deactivate the safety to permit the height lock-release actuator to be activated.

Referring to FIGS. 1 and 2, tabletop assembly 100 may include a height lock-release actuator 244 and a safety-release actuator 248 which are externally accessible for manual actuation (i.e. activation by hand-manipulation). Actuators 244 and 248 may take any suitable form. For example, actuators 244 and 248 may be slide switches as shown. Alternatively, actuators 244 and 248 may be push buttons, rotary switches, rocker switches, or another suitable actuator.

Still referring to FIGS. 1 and 2, in the illustrated embodiment, actuators 244 and 248 may be positioned proximate opposite lateral sides of tabletop 104. This may permit manual actuation of actuators 244 and 248 simultaneously while the user manually grasps the opposite lateral sides of tabletop 104 to support the weight of whatever tabletop 104 may be carrying at the time (e.g. a laptop or computer monitor). This may help to reduce the incidence of a user activating actuators 244 and 248 without supporting the weight of tabletop 104, whereby tabletop 104 may come crashing down under the weight of whatever tabletop 104 is carrying at the time. For example, each actuator 244 and 248 may be positioned within hand-reach of a respective lateral side of tabletop 104 (e.g. less than 12 inches from the lateral side).

Each actuator 244 and 248 may be accessible from upper tabletop end 172, and/or from lower tabletop end 176. In the illustrated embodiment, actuators 244 and 248 are accessible from both upper and lower tabletop ends 172 and 176. This may provide optimal flexibility for a user to activate actuators 244 and 248 while supporting tabletop 104 in a manner which suits the user's hand size.

Reference is now made to FIG. 7, where tabletop assembly 100 is shown from a top plan view with tabletop 104 removed. As illustrated, tabletop assembly 100 is in a raised position, and height lock-release actuator 244 and safety-release actuator 248 are deactivated. As shown, tabletop assembly 100 may include at least one height lock 252 and at least one a safety 256. In the illustrated embodiment, tabletop assembly 100 includes two height locks 252, and one safety 256.

Height lock 252 may take any suitable form. In some embodiments, height lock 252 may be engageable at every position between the raised and storage positions, and when engaged locks the height of the tabletop assembly 100 at that position. For example, height lock 252 may inhibit horizontal lateral sliding of the second leg ends 116 relative to tabletop 104 to fix the height of tabletop 104 above first leg ends 112 (which may rest on a horizontal surface, such as a desk).

Still referring to FIG. 7, height lock 252 may be coupled to crossbeam 144 for lateral movement therewith. As shown, height lock 252 may be mounted to a guide 260 (e.g. a laterally extending rod, rail, or other suitable structure). Height lock 252 may move along guide 260 as the height of tabletop assembly 100 is adjusted between the raised and storage positions. In the illustrated embodiment, guide 260 extends laterally from a proximal guide end 264 to a distal guide end 268. Referring to FIGS. 7 and 10, height lock 252 moves toward distal guide end 268 as tabletop assembly 100 is lowered from the raised position of FIG. 7 toward the lowered position of FIG. 10. In the example shown, the height of tabletop assembly 100 may be locked by arresting the relative movement between height lock 252 and guide 260. In one aspect, guides 260 may help to constrain crossbeams 144 and 148 and second leg ends 116 to sliding movement in the lateral direction.

Returning to FIG. 7, height lock 252 when engaged may act on guide 260 to inhibit sliding of height lock 252 (as well as the connected crossbeam 144 and second leg ends 116) relative to tabletop 104. Guide 260 may also be connected to second crossbeam 148. In the illustrated example, proximal guide end 264 is rigidly connected to second crossbeam 148. As tabletop assembly 100 is moved between the raised and storage positions (FIGS. 7 and 10, respectively), proximal guide end 264 moves laterally with second crossbeam 148 towards and away from first crossbeam 144, each crossbeam 144 and 148 carrying respective second leg ends 116. Accordingly, the lateral distance between first and second crossbeams 144 and 148 is locked when height lock 252 acts on guide 260 to inhibit sliding of height lock 252 and first crossbeam 144 relative to guide 260.

Height lock 252 may be biased to be normally engaged, thereby normally locking the height of tabletop assembly 100. In turn, height lock-release actuator 244 may be normally deactivated. Height lock-release actuator 244 may be manually activated to disengage height lock 252 to permit the height of tabletop assembly 100 to be adjusted by raising or lowering tabletop 104. Height lock-release actuator 244 may then be released by the user's hands, returning height lock-release actuator 244 to its deactivated state, whereby height lock 252 may return to its normally engaged state thereby locking the height of tabletop assembly 100 at the adjusted height.

Turning to FIG. 7, height lock 252 may be a friction lock which can frictionally engage guide 260 at any position along guide 260. In the illustrated example, height lock 252 includes first and second lock plates 272 and 276. Plates 272 and 276 may each extend from a proximal plate end 280 to a distal plate end 284. As shown, each plate 272 and 276 may be pivotably coupled to first crossbeam 144 at their respective proximal plate ends 280. An opening (obscured from view) may be formed in plates 272 and 276 between the proximal and distal plate ends 280 and 284 of each plate 272 and 276 for receiving guide 260. A lock bias 288 (e.g. a spring) may act on pivot plates 272 and 276 to pivot the plates 272 and 276 about their proximal plate ends 280. As shown, this may skew the openings in plates 272 and 276 whereby sidewalls of the openings are urged against guide 260, frictionally engaging guide 260. This frictional engagement of plates 272 and 276 against guide 260 under the influence of lock bias 288 resists relative sliding between height lock 252 and guide 260.

Figure 9:
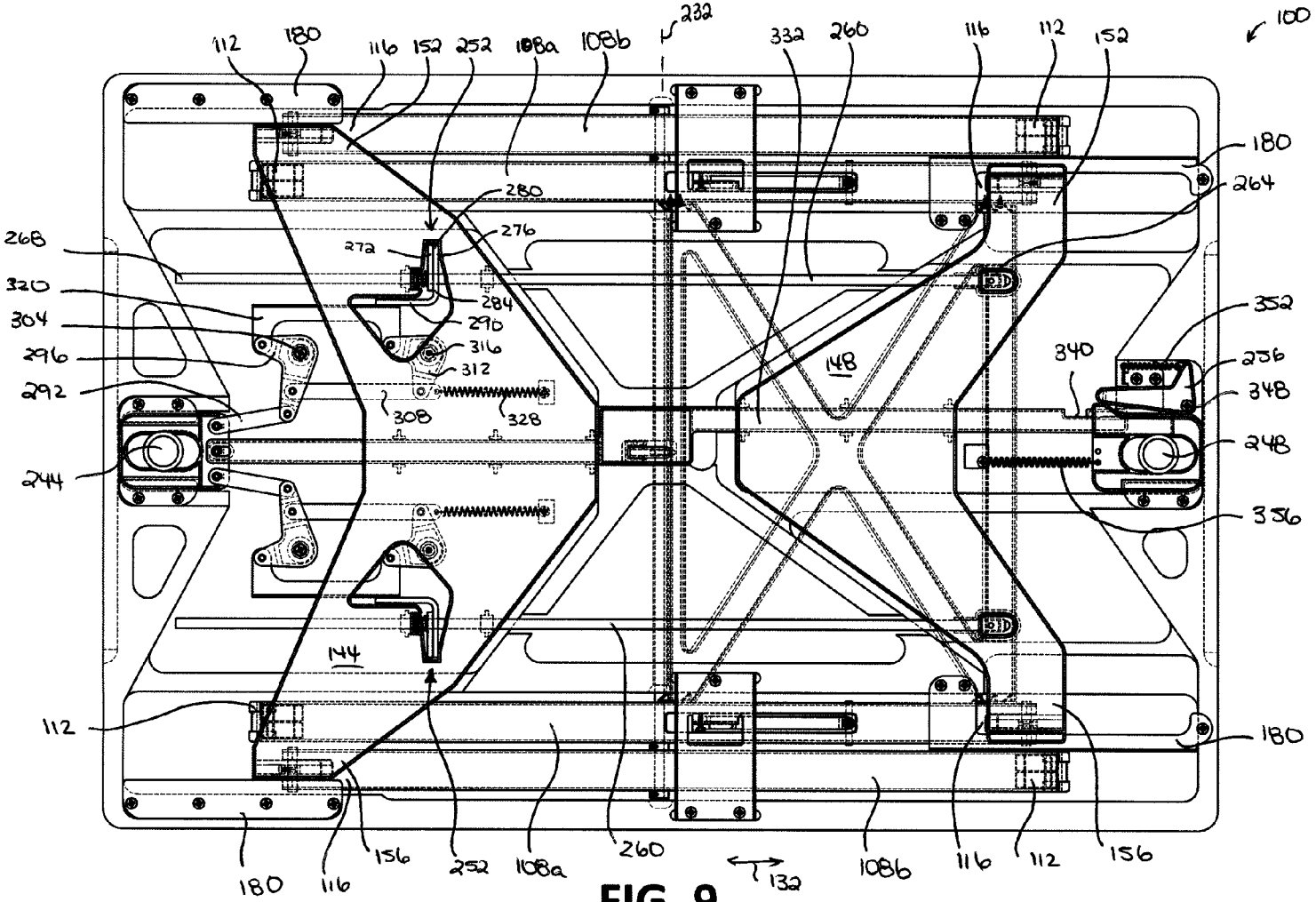
FIG. 9 is a top plan view of the tabletop assembly of FIG. 1, in the raised position, with the upper tabletop end omitted, with the height lock-release actuator and the safety-release actuator activated.

Reference is now made to FIG. 9 where height lock-release actuator 244 is shown in an activated condition. Activating height lock-release actuator 244 may cause plates 272 and 276 to pivot about their proximal plate ends 280 against the bias of lock bias 288 thereby unskewing the openings in plates 272 and 276, and releasing guide 260 from frictional engagement of lock plates 272 and 276. As shown, distal end 284 of second lock plate 276 of height lock 252 may include a release lever 290 which extends in a lateral direction. Release lever 290 may be activated by a longitudinally outwardly directed force whereby first and second lock plates 272 and 276 may pivot about their proximal plate ends 280 against the bias of lock bias 288.

In the illustrated example, a first release linkage 292 is pivotally connected to height lock-release actuator 244, and the other end of the first release linkage 292 is pivotally connected to a first end of second release linkage 296. Second release linkage 296 has an elbow shape and is pivotally connected to a fixed position 304 on tabletop 104.

A third release linkage 308 is pivotally connected at its first end to second release linkage 296 between pivot position 304 and first release linkage 292. The third release linkage 308 is pivotally connected at its second end to a first end of a fourth release linkage 312. Fourth release linkage 312 has an elbow shape and is pivotally connected at a fixed position 316 on tabletop 104. A release bar 320 is pivotally connected to the second ends of the second and fourth release linkages 296 and 312. As shown, the release bar 320 may be laterally aligned with release lever 290.

Reference is now made to FIG. 7, in which height lock-release actuator is deactivated, and FIG. 9, in which height lock-release actuator is activated. Height lock-release actuator 244 is activated by manually moving height lock-release actuator 244 laterally outwardly. This moves the connected first release linkage 292 laterally outwardly which pivots second release linkage 296 about its pivot 304. In turn, second release linkage 292 moves third release linkage 308 laterally outwardly, which pivots fourth release linkage 312 about its pivot 316. The rotation of second and fourth release linkages 296 and 312 about their pivots 304 and 316 moves release bar 320 longitudinally outwardly whereby release bar 320 urges release lever 290 longitudinally outwardly. In turn, first and second lock plates 272 and 276 pivot against the bias of lock bias 288, releasing guide 260 from frictional engagement.

Figure 12:
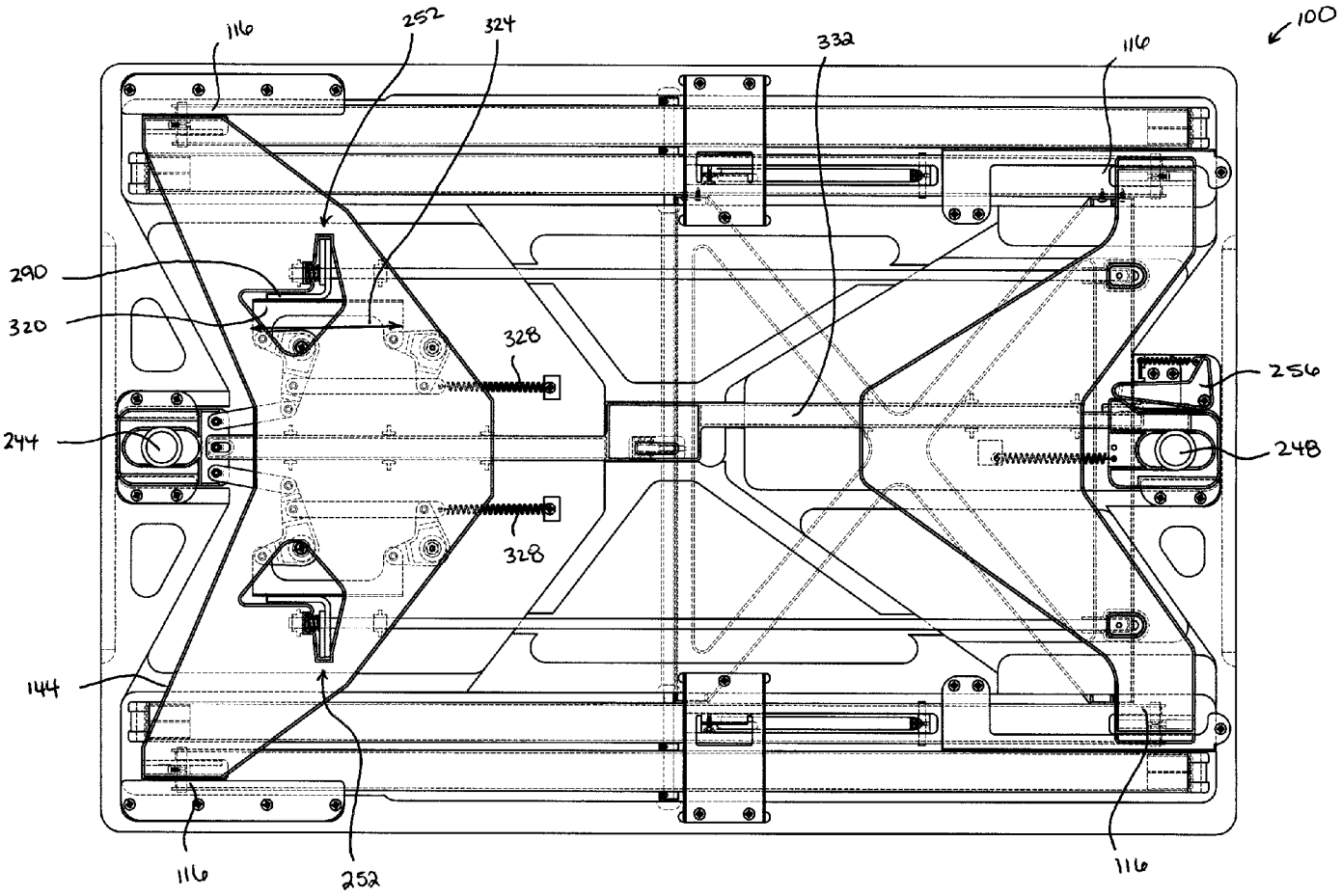
FIG. 12 is a top plan view of the tabletop assembly of FIG. 1, in the storage position, with the upper tabletop end omitted, with the height lock-release actuator and the safety-release actuator activated.

Reference now made to FIG. 9, which shows height lock-release actuator 244 engaged while tabletop assembly 100 is in a raised position, and FIG. 12, which shows height lock-release actuator 244 engaged while tabletop assembly is in a storage position. As shown, first crossbeam 144 and height lock 252 (including release bar 320) move laterally relative to the height lock-release mechanism (including release lever 290) when tabletop assembly 100 is moved between the raised position and the storage positions. For example, the lateral position of height lock-release mechanism, including release lever 290, may be stationary relative to tabletop 104 during movement between the raised and storage positions. First crossbeam 144, along with height lock 252 and second leg ends 116, may slide laterally relative to tabletop 104 across a lateral range of motion. As exemplified, release bar 320 may have a lateral bar width 324 equal to or greater than the lateral range of motion of height lock 252 between the raised and storage positions. This may permit release bar 320 to remain laterally aligned with release lever 290 of height lock 252 at every position of height lock 252 between the raised and storage positions.

Referring to FIG. 7, height lock-release actuator 244 may be biased to its deactivated condition in any suitable fashion. In the illustrated embodiment, the height lock-release mechanism includes a lock-release bias 328 (e.g. linear coil spring) coupled to third release linkage 308 which urges the third release linkage 308 laterally inwardly. In turn, this urges height lock-release actuator 244 laterally inwardly to its deactivated condition.

Still referring to FIG. 7, tabletop assembly 100 may include one or more height lock-release actuators 244, one or more associated height lock-release mechanisms, and one or more height locks 252. In the illustrated embodiment, tabletop assembly 100 includes one height lock-release actuator 244 which controls two different height lock-release mechanisms for selectively disengaging two height locks 252. The two height locks 252 are connected to longitudinally opposite portions of first crossbeam 144 and slide along different guides 260 (each guide 260 extending from an opposite longitudinal portion of second crossbeam 148). Accordingly, when height lock release actuator 244 is deactivated, both height locks 252 may frictionally engage their corresponding guide 260. Similarly, when height lock release actuator 244 is activated, both height locks 252 may frictionally disengage their corresponding guide 260. In one aspect, having two height locks 252, one each on opposite longitudinal ends of tabletop 104, may enhance the stability of tabletop assembly 100. In another aspect, having two locks 252, one each on opposite longitudinal portions of crossbeam 144 may longitudinally balance the reactive lateral forces on crossbeams 144 and 148 from locks 252 and guides 260, which may help to prevent jamming of crossbeams 144 and 148.

With continuing reference to FIG. 7, tabletop assembly 100 may include a height lock bar 332 connected to safety-release actuator 248 for lateral movement in synchronicity with safety-release actuator 248. As shown, height lock bar 332 may be a rigid member which extends laterally between safety-release actuator 248 and safety 256. Safety 256, when activated, may act on height lock bar 332 to inhibit lateral movement of height lock bar 332 relative to tabletop 104, and thereby inhibit lateral movement of safety-release actuator 248 to activate safety-release actuator 248. Accordingly, it may require activating safety-release actuator 248 to deactivate safety 256 in order to free height lock-release actuator 244. In one aspect, this two-step design may reduce the risk of accidental actuation of height lock-release actuator 244 (whereby tabletop 104 may come crashing down if not manually supported).

Reference is now made to FIG. 7A, in which safety 256 is activated and safety-release actuator 248 is deactivated, and 8A, in which safety 256 is deactivated and safety-release actuator 248 is activated. Safety 256 may take any suitable form. In the illustrated embodiment, safety 256 is formed as a latch which includes a protrusion 336 for engaging a groove 340 of height lock bar 332. As shown in FIG. 7A, when safety 256 is activated, protrusion 336 may engage groove 340 to prevent height lock bar 332 from sliding laterally to activate height lock-release actuator 244.

Still referring to FIGS. 7A and 8A, safety-release actuator 248 may be a slide switch which is laterally slideable between activated and deactivated conditions. Safety-release actuator 248, when activated, may disengage safety 256 from height lock bar 332. For example, activating safety-release actuator 248 may move safety-release actuator 248 to withdraw protrusion 336 from groove 340 to permit height lock bar 332 to slide horizontal (e.g. by activation of height lock-release actuator 244). In the illustrated example, safety-release actuator 248 includes a cam surface 344 formed as a ramp. Safety-release actuator 248 may ride the cam surface 344 as safety-release actuator 248 is activated, thereby removing protrusion 336 from groove 340.

Safety 256 may be biased to be normally activated in any suitable fashion. In the illustrated embodiment, safety 256 is pivotally connected to tabletop 104 at a pivot position 348, and rotatable about pivot position 348 between its activated and deactivated conditions. As shown, a safety bias 352 (e.g. a linear coil spring) may act on safety 256 to urge safety 256 to rotate to its activated condition. When safety-release actuator 248 is activated, safety 256 may rotate against the bias of safety bias 352 as it rides cam surface 344.

Safety-release actuator 248 may be biased to be normally deactivated in any suitable fashion. As shown, a safety-release bias 356 (e.g. a linear coil spring) may urge safety-release actuator 248 laterally inwardly to its deactivated condition. In use, safety-release actuator 248 may be manually movable laterally outwardly against the bias of safety-release bias 356 to activate safety-release actuator 248.

Figure 8:
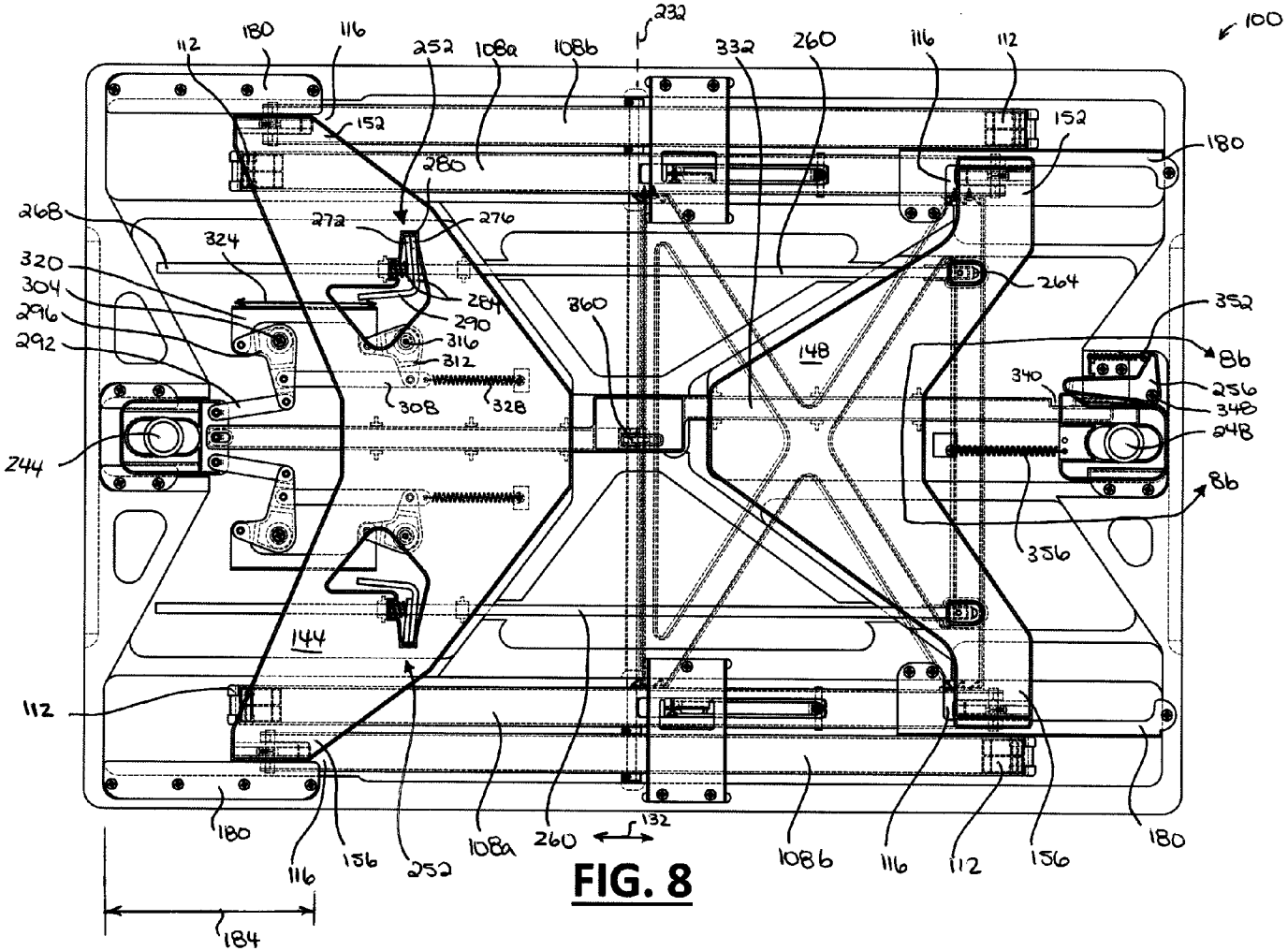
FIG. 8 is a top plan view of the tabletop assembly of FIG. 1, in the raised position, with the upper tabletop end omitted, with the height lock-release actuator deactivated, and with the safety-release actuator activated.
Figure 7B:
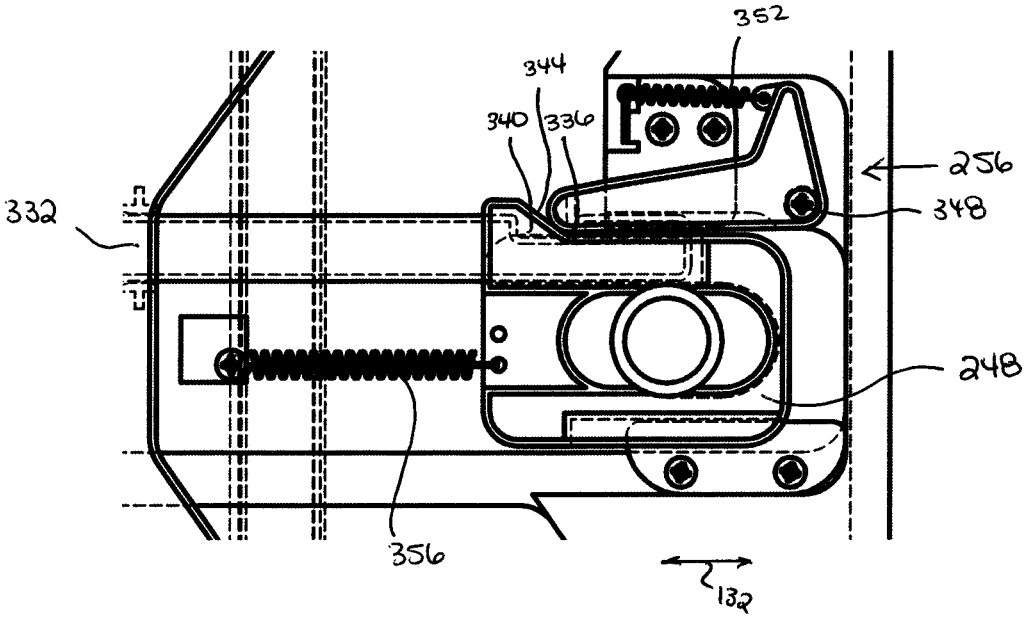
FIG. 7B is a partial view of region 7B-7B in FIG. 7.
Figure 8B:
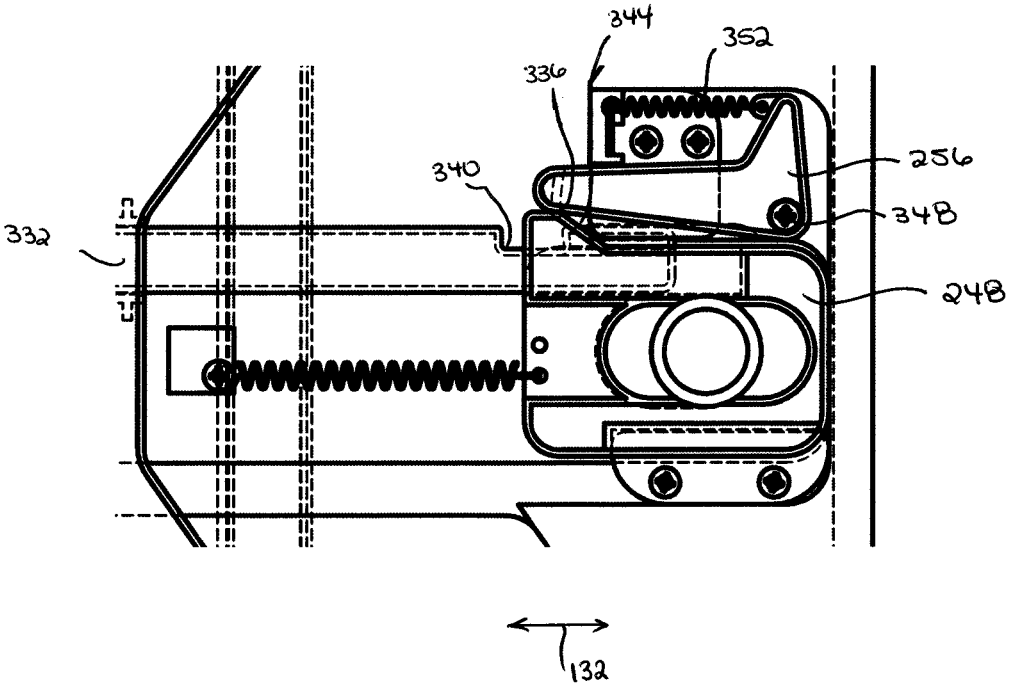
FIG. 8B is a partial view of region 8B-8B in FIG. 8.

FIGS. 7-9 illustrate steps in a method of adjusting the height of tabletop assembly 100. FIG. 7 shows tabletop assembly 100 in a raised position with height lock-release actuator 244 and safety-release actuator 248 deactivated, and with height lock 252 and safety 256 activated. In this condition, the height of tabletop assembly 100 is locked to the raised position, and height lock-release actuator 244 is inhibited from activation by safety 256. A user may grasp opposite lateral ends of tabletop 104 to support the weight of tabletop 104 and whatever is then carried by tabletop 104, and position their fingers over safety-release actuator 248 and height lock-release actuator 244 for sequential manipulation.

FIG. 8 shows tabletop assembly 100 after safety-release actuator 248 has been activated. As shown, activating safety-release actuator 248 has deactivated safety 256, whereby safety 256 has disengaged height lock bar 332 thereby permitting height lock-release actuator 244 to be released. Height locks 252 remain engaged.

FIG. 9 shows tabletop assembly 100 with height lock-release actuator 244 sequentially activated after activating safety-release actuator 248. Activating height lock-release actuator 244 has disengaged height locks 252. The user may now lower tabletop 104 to any desired height, and then release height lock-release actuator 244 to re-engage height locks 252.

Figure 11:
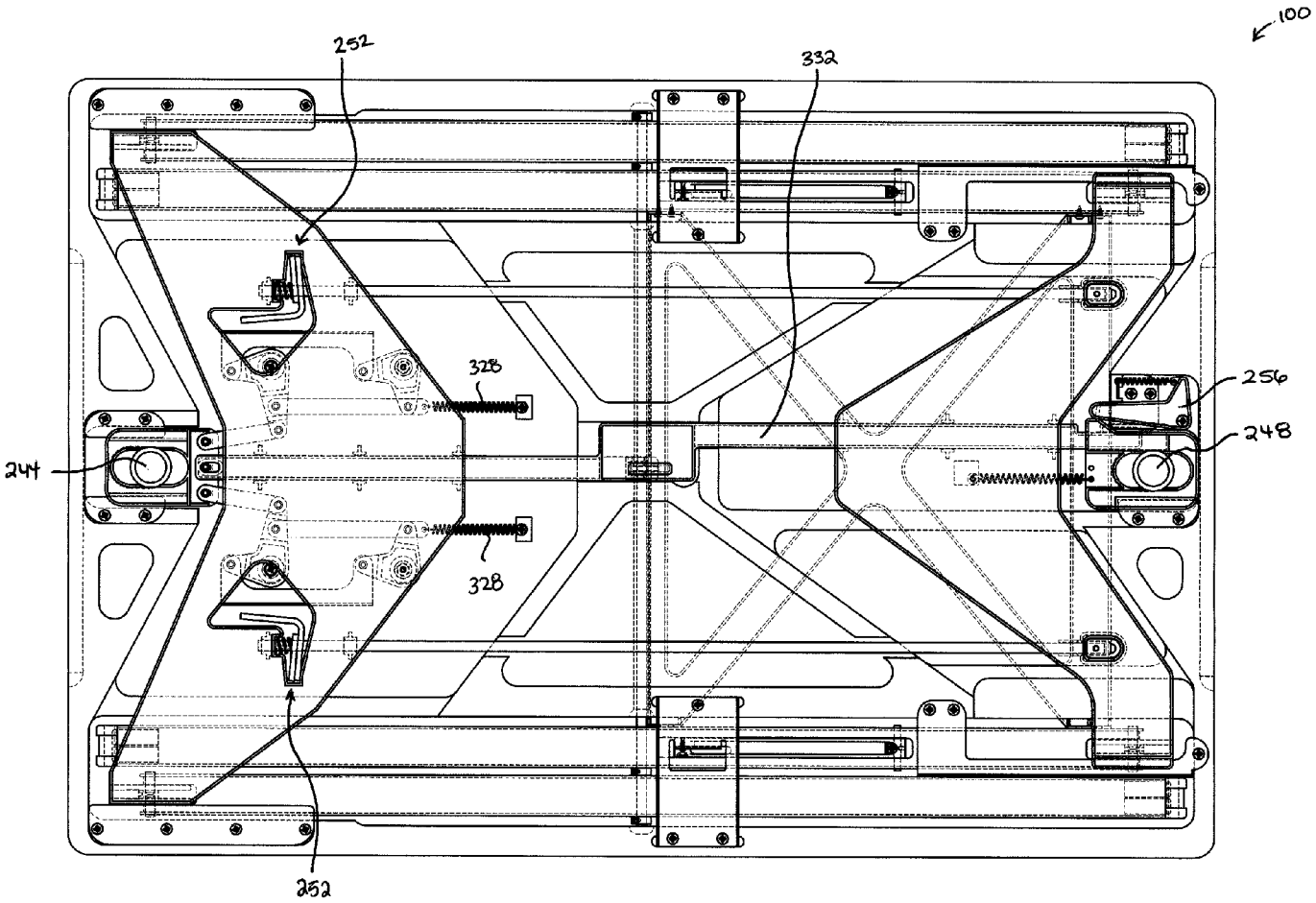
FIG. 11 is a top plan view of the tabletop assembly of FIG. 1, in the storage position, with the upper tabletop end omitted, with the height lock-release actuator deactivated, and with the safety-release actuator activated.

FIG. 11 shows tabletop assembly 100 in the storage position after safety-release actuator 248 has been activated. As shown, activating safety-release actuator 248 has deactivated safety 256, whereby safety 256 has disengaged height lock bar 332 thereby permitting height lock-release actuator 244 to be released. Height locks 252 remain engaged.

FIG. 12 shows tabletop assembly 100 in the storage position with height lock-release actuator 244 sequentially activated after activating safety-release actuator 248. Activating height lock-release actuator 244 has disengaged height locks 252. The user may now lower tabletop 104 to any desired height, and then release height lock-release actuator 244 to re-engage height locks 252.

In some embodiments, tabletop assembly 100 may include a storage lock, which when activated retains legs 108 in the storage position. This may provide additional security against tabletop assembly 100 unexpectedly expanding from the storage position to a raised position during transportation or storage. The storage lock may take any suitable form. Referring to FIG. 2, a storage lock 360 is shown extending through lower tabletop end 176. In the illustrated example, storage lock 360 may act on crossbar 124, when in the storage position, to inhibit vertical movement of crossbar 124 relative to tabletop 104, thereby retaining legs 108 in the storage position. For example, storage lock 360 may be formed as a hook as shown which latches onto crossbar 124 when crossbar 124 is received in groove 208.

Figure 13:
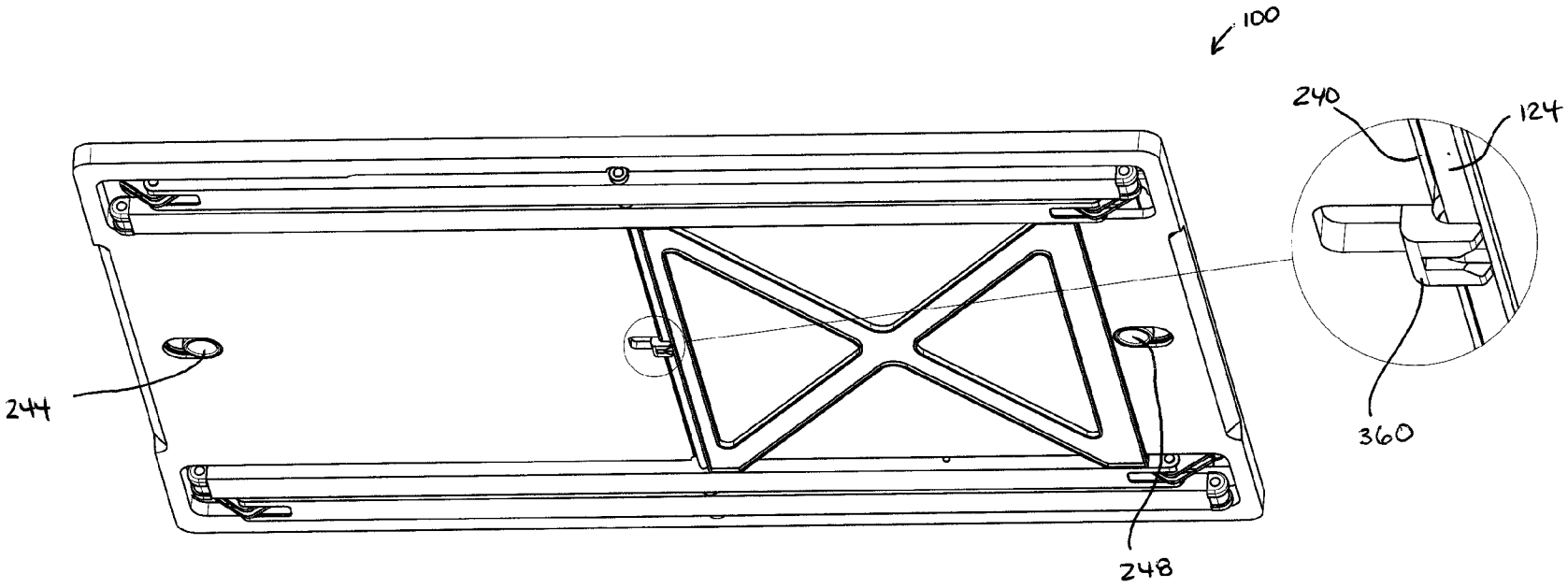
FIG. 13 is a bottom perspective view of the tabletop assembly of FIG. 1, in the storage position, with a storage lock activated.
Figure 14:
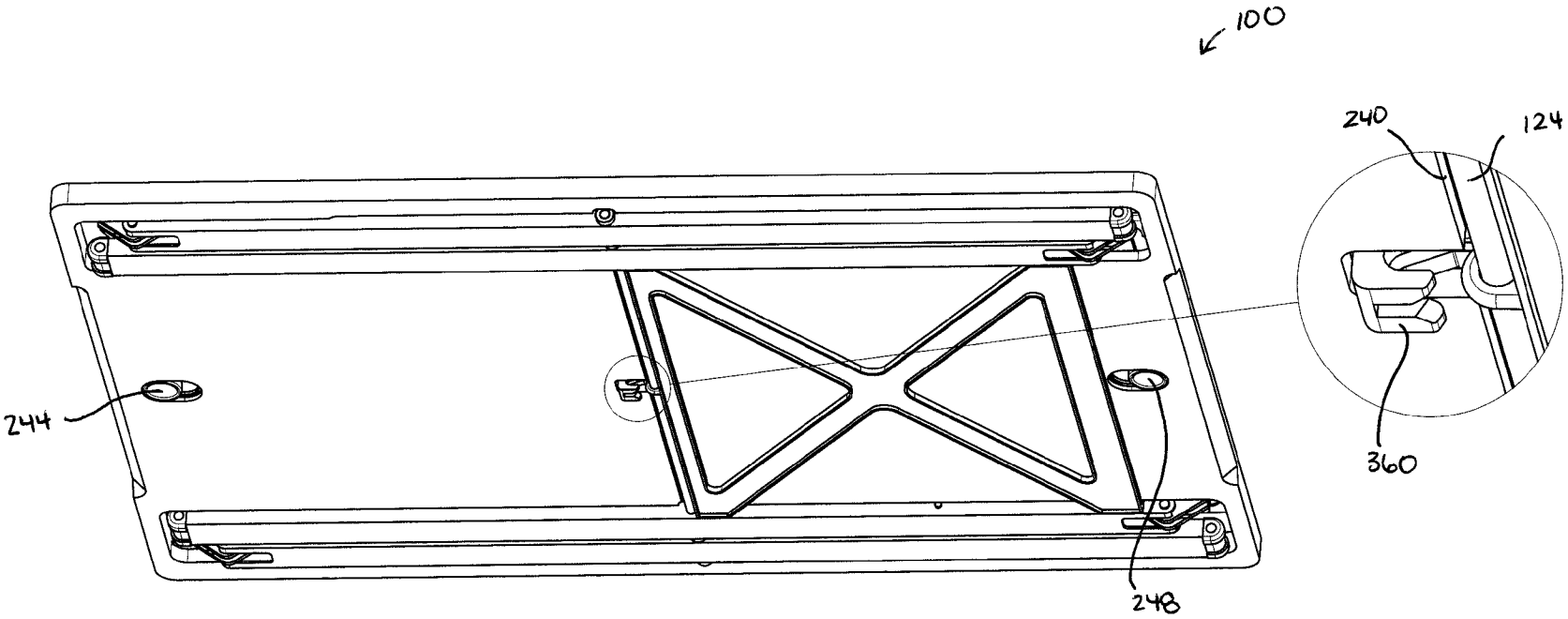
FIG. 14 is a bottom perspective view of the tabletop assembly of FIG. 1, in the storage position, with the storage lock deactivated

Reference is now made to FIGS. 10 and 13, which show tabletop assembly 100 in the storage position with storage lock 360 activated and engaged with crossbar 124. As shown, storage lock 360 may extend downwardly from height lock bar 332 for lateral movement therewith. This may permit storage lock 360 to be automatically activated and deactivated as the user manipulates actuators 244 and 248 to raise and lower tabletop 104. For example, before a user can raise tabletop 104 from the storage position, height lock-release actuator 244 must be activated to deactivate height locks 252. By activating height lock-release actuator 244, height lock bar 332 is moved laterally which deactivates storage lock 360 thereby permit crossbar 124 to move vertically as tabletop 104 is moved out of the storage position. Similarly, before a user can lower tabletop 104 to the storage position, height lock release actuator 244 must be activated to deactivate height locks 252. Activating height lock-release actuator 244 moves lock 360 to the side to permit passage of crossbar 124 into groove 240 in the storage position (see FIGS. 12 and 14). When height lock-release actuator 244 is released, lock 360 moves laterally with height lock bar 332 (under the bias of lock-release bias 328) thereby activating lock 360 into engagement with crossbar 124.

Figure 17:
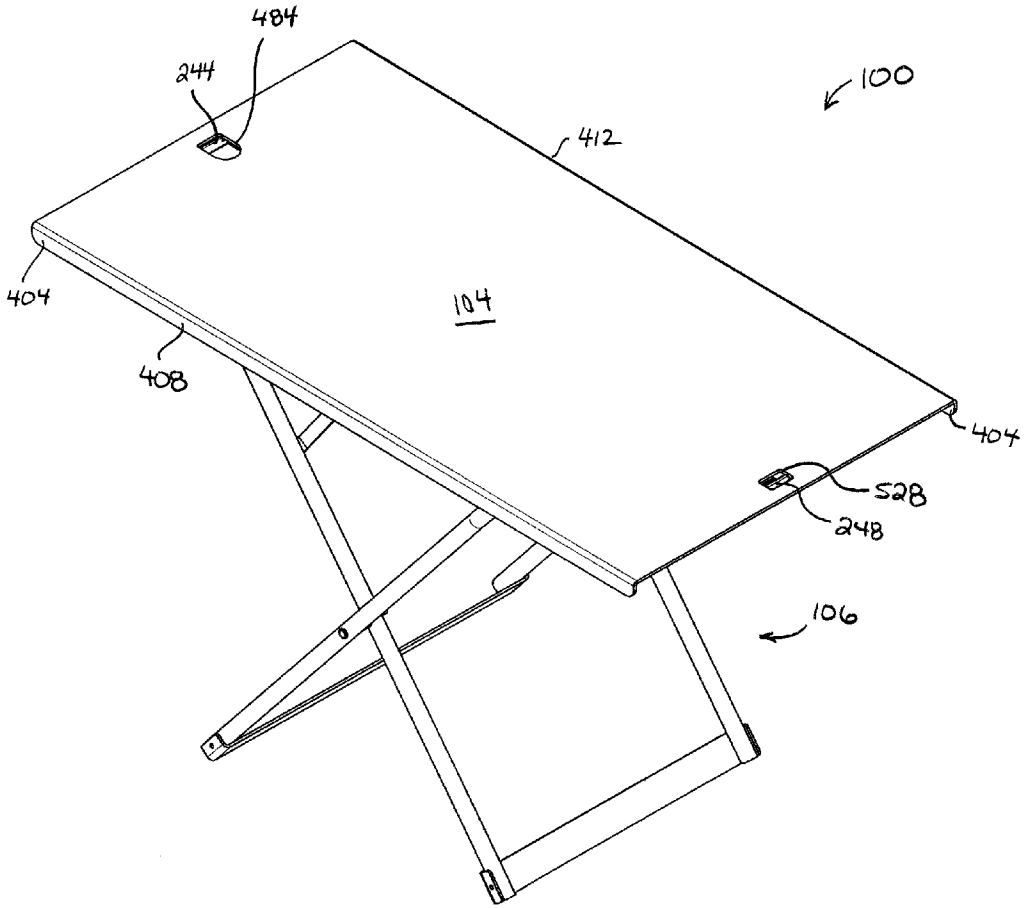
FIG. 17 is a top perspective view of a tabletop assembly in a raised position, in accordance with another embodiment.
Figure 18:
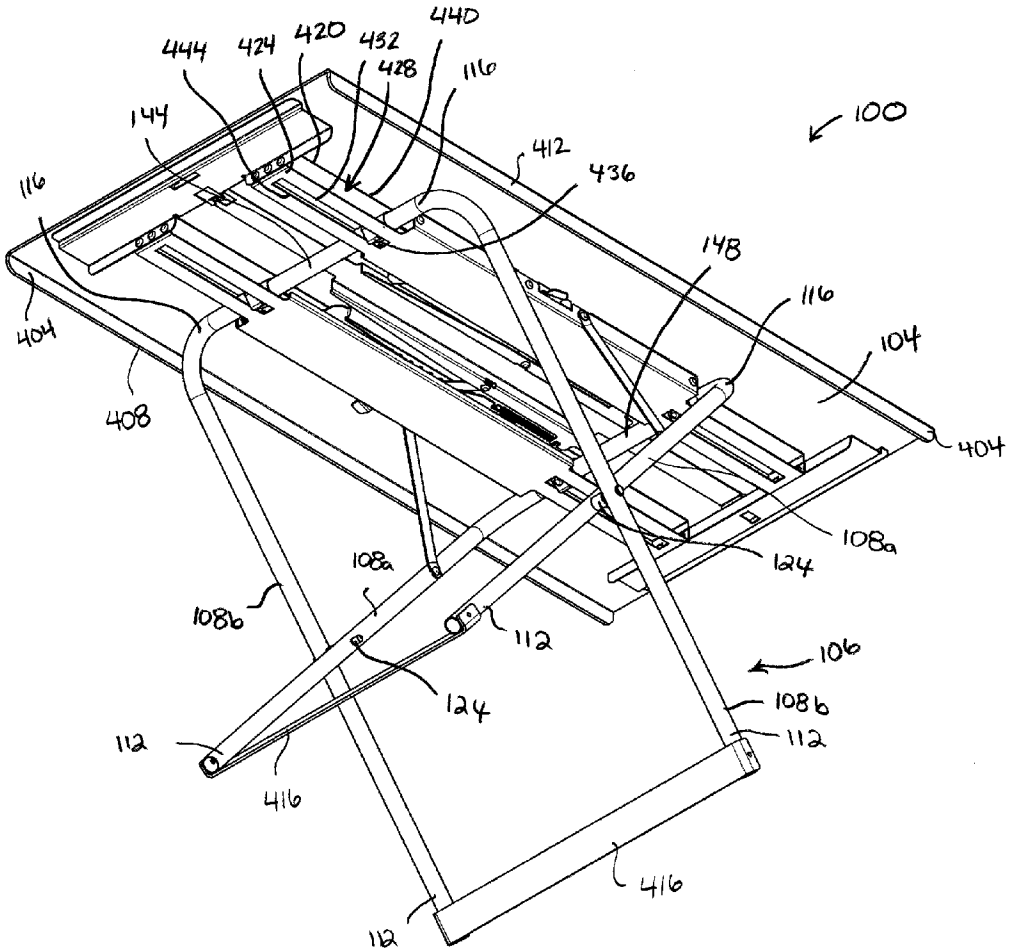
FIG. 18 is a bottom perspective view of the tabletop assembly of FIG. 17.
Figure 19:
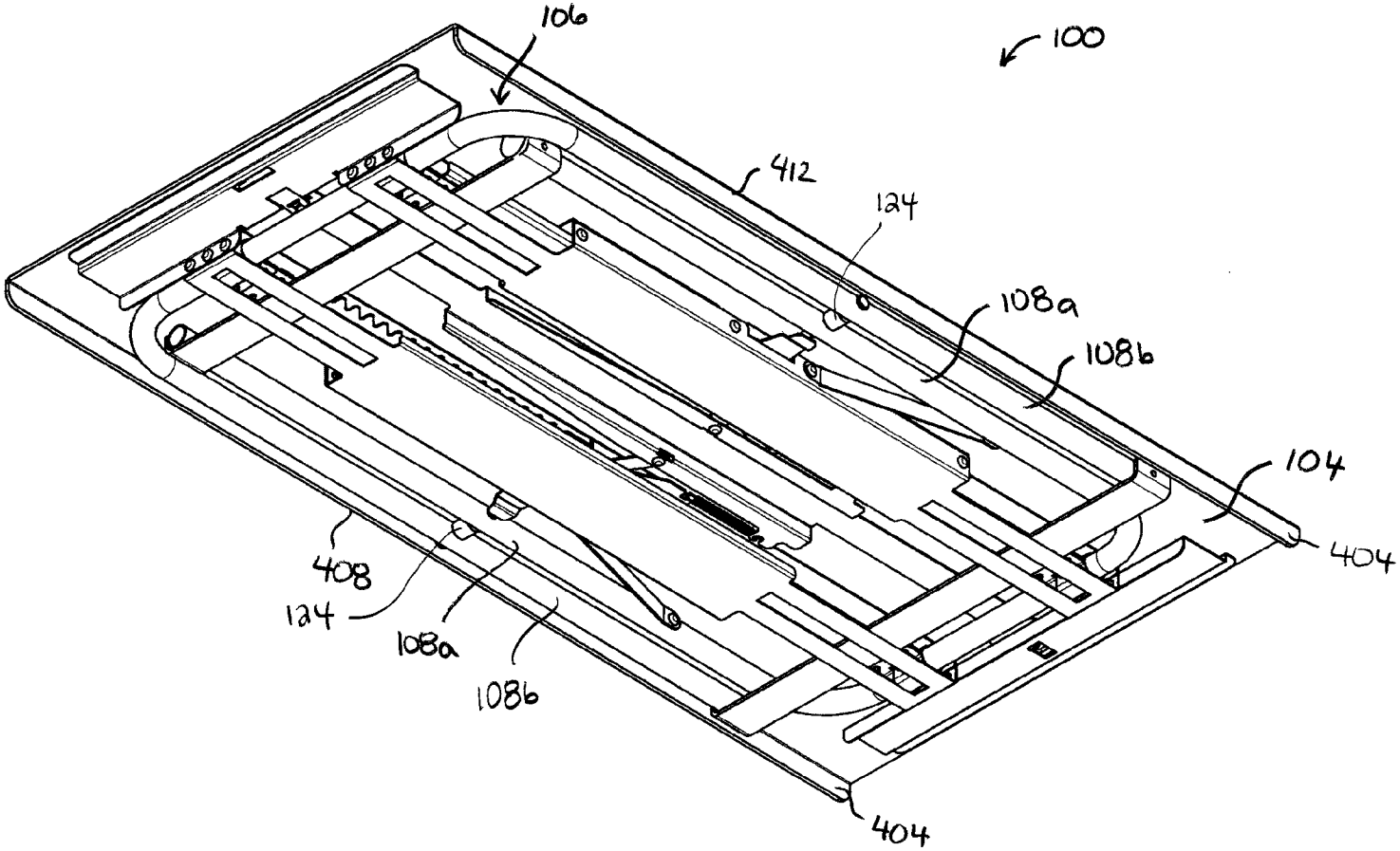
FIG. 19 is a bottom perspective view of the tabletop assembly of FIG. 17 in a lowered position.

FIGS. 17-19 show another embodiment of tabletop assembly 100. As shown, tabletop assembly 100 includes a tabletop 104 and a height adjustable support structure 106. Tabletop 104 may be made of any material suitable for supporting articles (e.g. laptop, books, papers, etc.), such as metal, wood, plastic, glass, ceramic, or combinations thereof. In the illustrated example, tabletop 104 is made of a single acrylic sheet. Optionally, tabletop 104 may be bent to form flanges 404 which define the front and rear longitudinally opposed ends 408 and 412 of tabletop 104.

Turning to FIG. 18, height adjustable support structure 106 is shown including two pairs of legs 108*a* and 108*b*, where each pair of legs 108*a* and 108*b* is pivotally connected by a crossbar 124. As shown, this allows legs 108 to fold in a scissor-like manner between a raised position (FIG. 18) and a lowered (e.g. storage) position (FIG. 19).

Still referring to FIG. 18, legs 108 may have any configuration suitable for supporting tabletop 104 between the raised and lowered positions. In the illustrated example, legs 108 are formed from lengths of tubing which extend from first leg ends 112 to second leg ends 116. Optionally, first leg ends 112 of longitudinally opposed legs 108 may be joined by a longitudinally foot 416 as shown. In the example shown, height adjustable support structure 106 includes two feet 416—one for each pair of longitudinal opposed first leg ends 112. Where tabletop assembly 100 is positioned on a raised surface, such as a desk, feet 416 may provide continued support for tabletop assembly 100 in the event that one or more of first leg ends 112 moves off the edge of the raised surface. In alternative embodiments, first leg ends 112 are not connected by feet 416.

Figure 20:
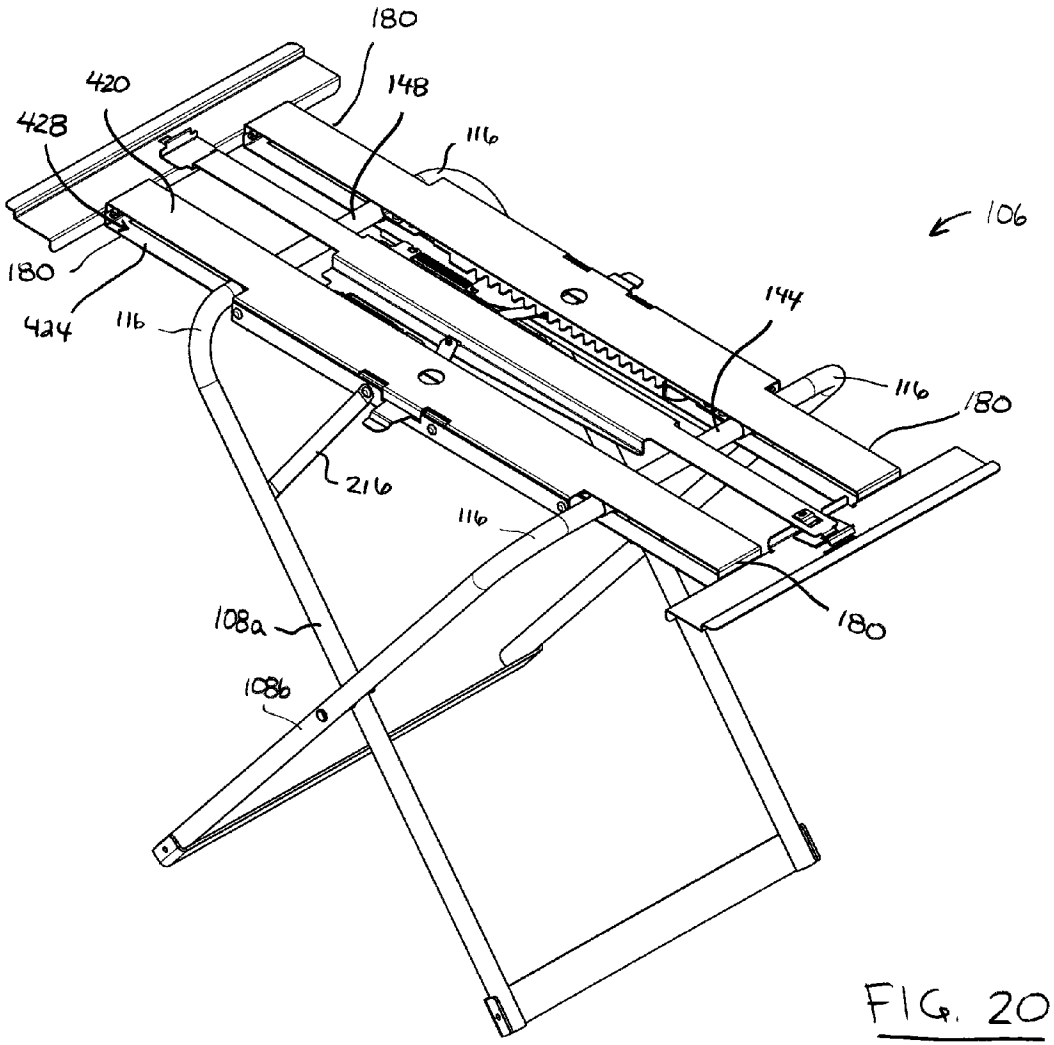
FIG. 20 is a top perspective view of a height adjustable support structure in a raised position, in accordance with at least one embodiment.

Turning to FIG. 20, longitudinally opposed second leg ends 116 of legs 108*b* are connected by first crossbeam 144, and longitudinally opposed second leg ends 116 of legs 108*a* are connected by second crossbeam 148. In the illustrated example, first crossbeam 144 and legs 108*b* are integrally formed as a single length of tubing, and crossbeam 148 and legs 108*a* are integrally formed as a single length of tubing. Alternatively, crossbeams 144 and 148, and legs 108*a* and 108*b* are discrete components that are connected together.

Crossbeams 144 and 148 are mounted to guide rails 180 in which they are laterally slidable as height adjustable support structure 106 moves between the raised position (FIG. 18) and the lowered position (FIG. 20). As shown, each guide rail 180 includes an upper portion 420 that is vertically spaced apart from a lower portion 424 to define a laterally extending slot 428. Each crossbeam 144 and 148 is positioned in a guide rail slot 428, which allows the crossbeams 144 to move laterally towards and away from each other as the legs 108 pivot in a scissor-like motion between the raised and lowered positions.

Height adjustable support structure 106 may include one or more guide rails 180 for each crossbeam 144 and 148. In the illustrated embodiment, height adjustable support structure 106 includes two longitudinally spaced apart guide rails 180 for each crossbeam 144 and 148. In alternative embodiment, height adjustable support structure 106 may include just one guide rail 180 for each crossbeam 144 and 148, or more than two guide rails 180 for each crossbeam 144 and 148.

Referring to FIG. 18, one or both of upper and lower guide rail portions 420 and 424 may include a laterally extending rail portion slot 432. Rail portion slot 432 is sized and positioned to receive a protrusion 436 connected to a crossbeam 144 or 148. As shown, protrusion 436 slides laterally along rail portion slot 432 as crossbeam 144 and 148 move laterally along guide rails 180. Guide rail slots 428 include longitudinally facing openings 440 that receive a longitudinally extending crossbeam 144 or 148. In this example, guide rail slots 428 may not provide longitudinal stability to crossbeams 144 and 148. Rail portion slots 432 are shown including vertically facing openings 444, which receive vertically extending rail portion slot protrusions 436. In this example, rail portion slots 432 may provide longitudinally stability, in that rail portion slot protrusions 436 are inhibited from moving longitudinally by their respective rail portion slot 432.

Referring to FIG. 20, height adjustable support structure 106 is shown including a centering arm 216. As shown, centering arm 216 is pivotally connected to a first leg 108*a*, and pivotally connected to a stationary component of height adjustable support structure 106 to keep legs 108 substantially centered as they move in a scissor-like manner between the raised and lowered positions.

Figure 21A:
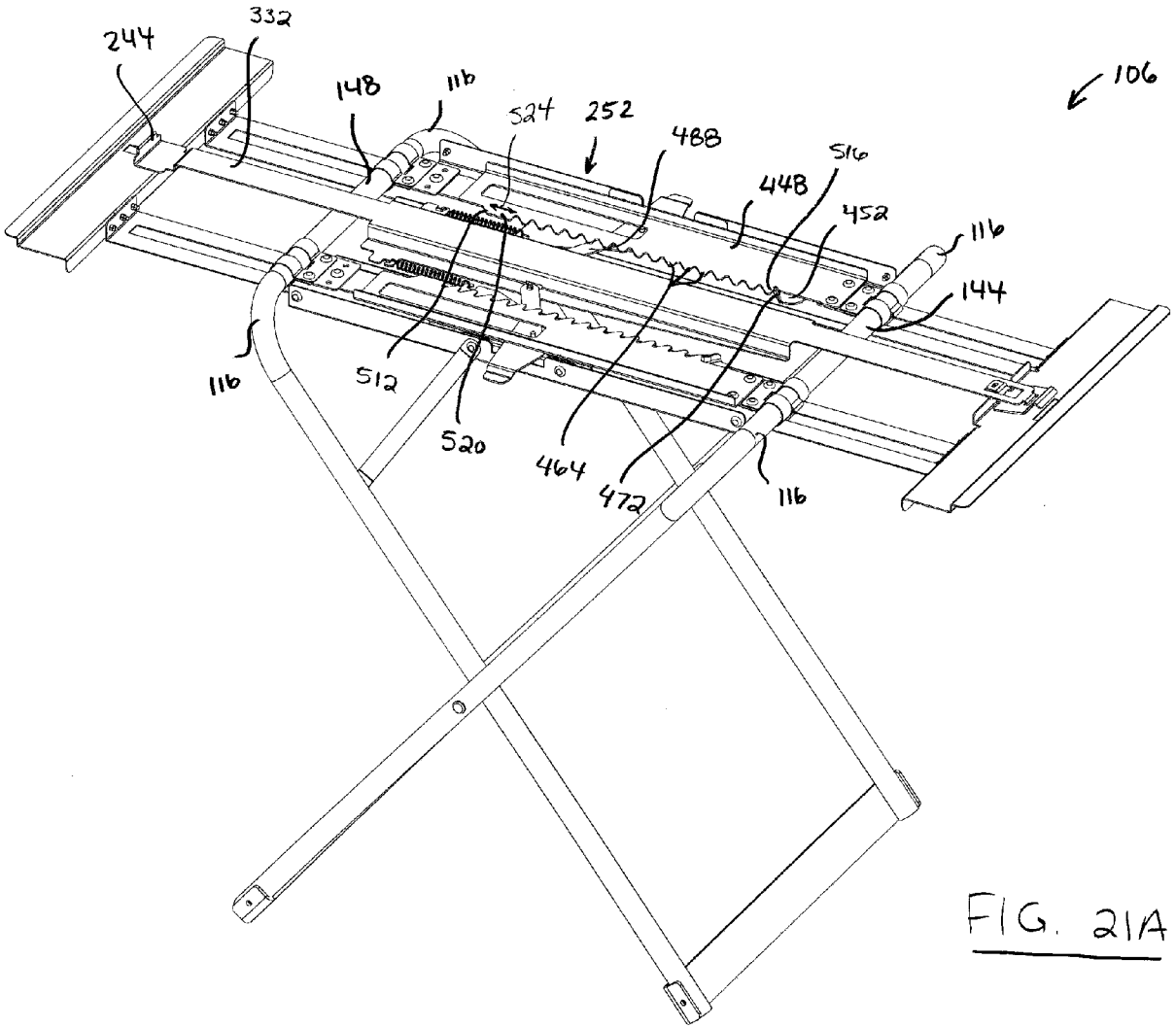
FIG. 21A is a top perspective view of the height adjustable support structure of FIG. 20 with a guide rail upper portion removed, and a height lock in a locked position.
Figure 21B:
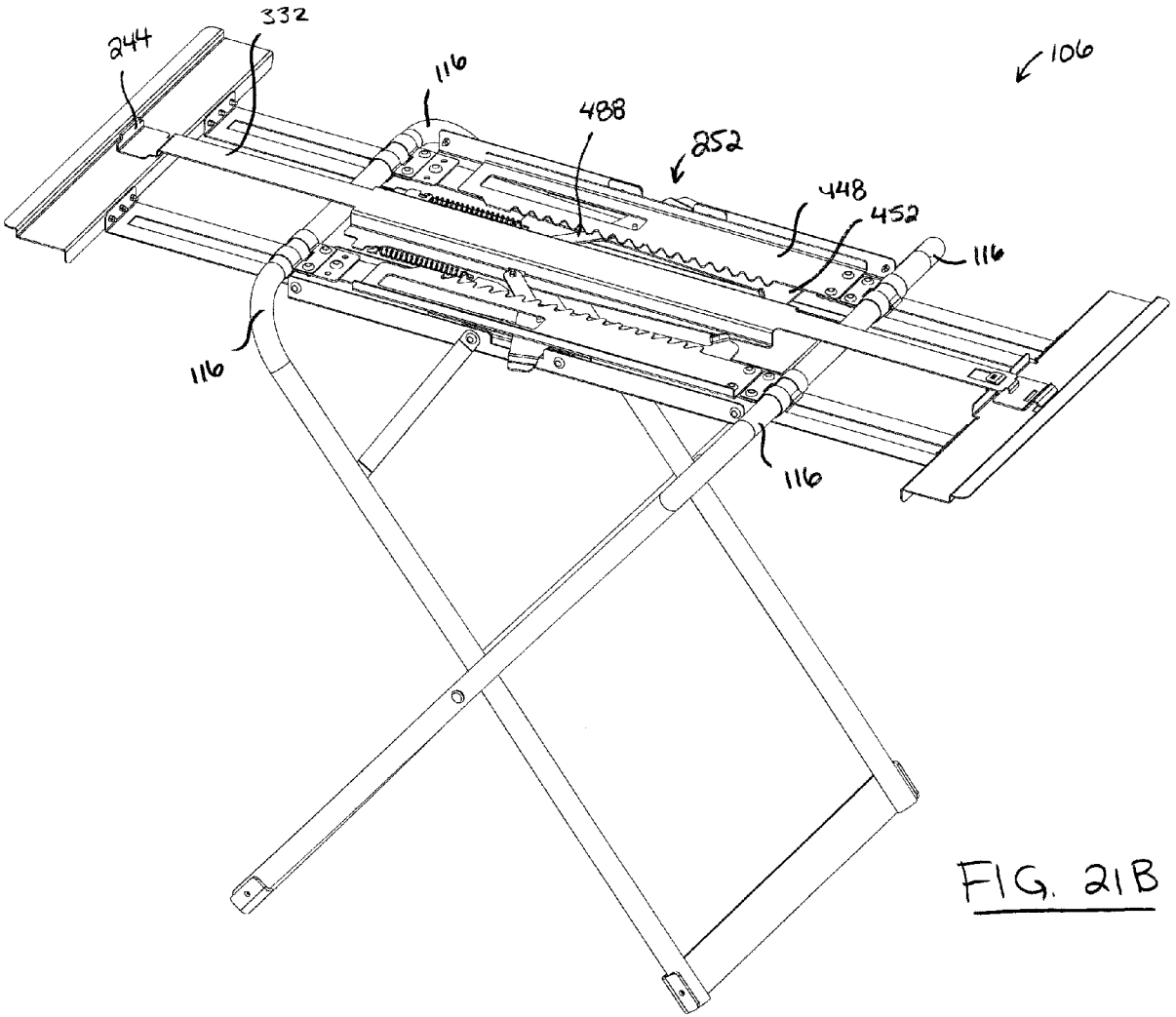
FIG. 21B is a top perspective view of the height adjustable support structure of FIG. 20 with the guide rail upper portion removed, and the height lock in an unlocked position.

Turning now to FIG. 21A, height adjustable support structure 106 includes a height lock 252. As shown, height lock 252 may be configured as a ratchet-type mechanism including a toothed rack 448 and a tooth-engaging pawl 452. Rack 448 and pawl 452 may be connected to laterally opposed second leg ends 116 (e.g. by way of crossbeams 144 and 148) as illustrated. When rack 448 is engaged with pawl 452, as in FIGS. 21A and 22A, the height lock 252 inhibits the laterally opposed second leg ends 116 from moving laterally outwardly or inwardly, so that the scissor-type height adjustment is locked in place. When rack 448 is disengaged from pawl 452, as in FIGS. 21B and 22B, laterally opposed second leg ends 116 are once again free to move laterally away or towards each other to move between the raised position (FIG. 21B) and the lowered position (FIG. 22B).

Referring to FIG. 21A, height lock 252 can include any number of rack and pawl pairs. In the illustrated example, height lock 252 includes two pairs of racks 448 and pawls 452. In alternative embodiments, height lock 252 may include just one rack 448 and one pawl 452, or more than two pairs of racks 448 and pawls 452.

Figure 22A:
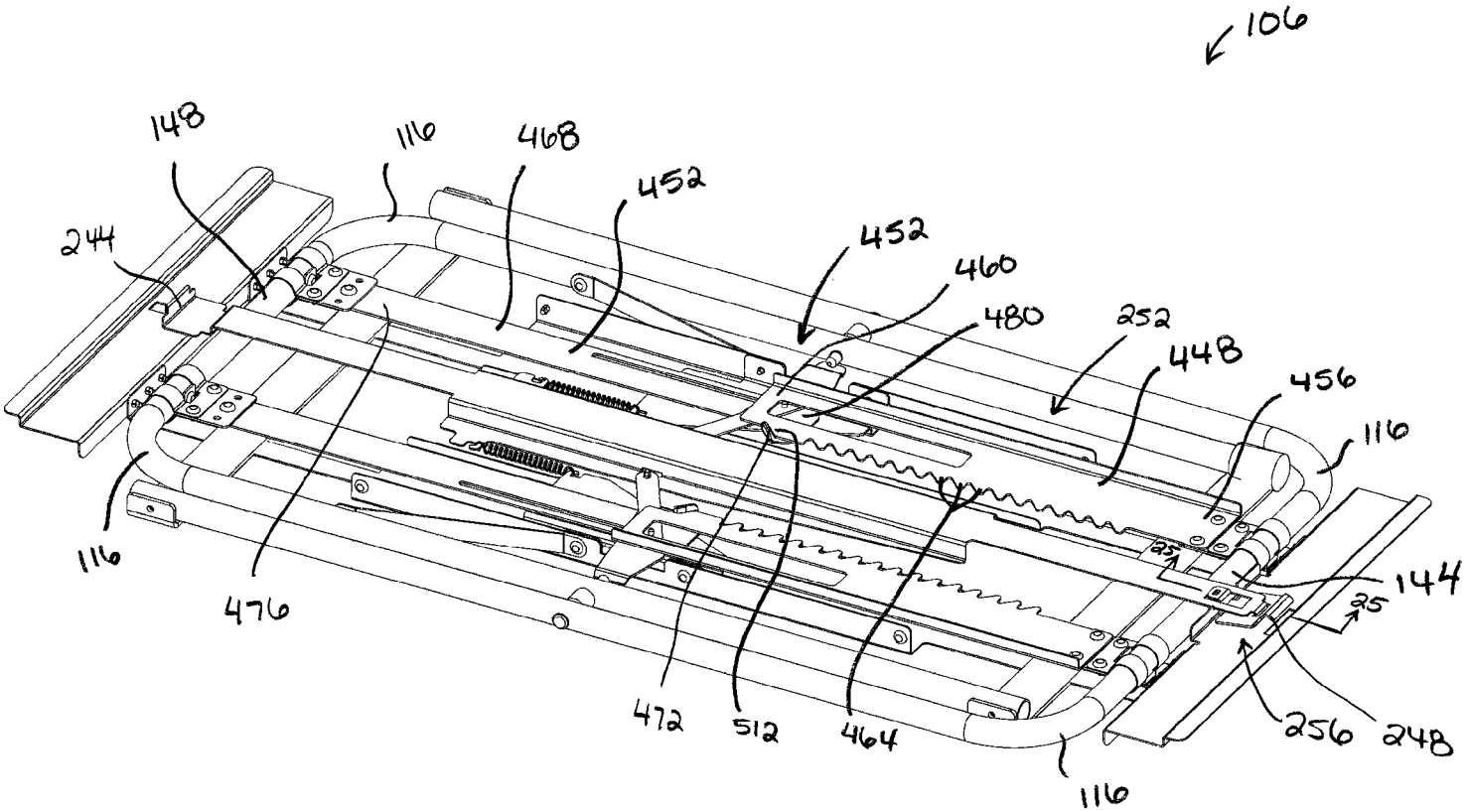
FIG. 22A is a top perspective view of the height adjustable support structure of FIG. 20 in a lowered position with the guide rail upper portion removed, and a height lock in the locked position.
Figure 22B:
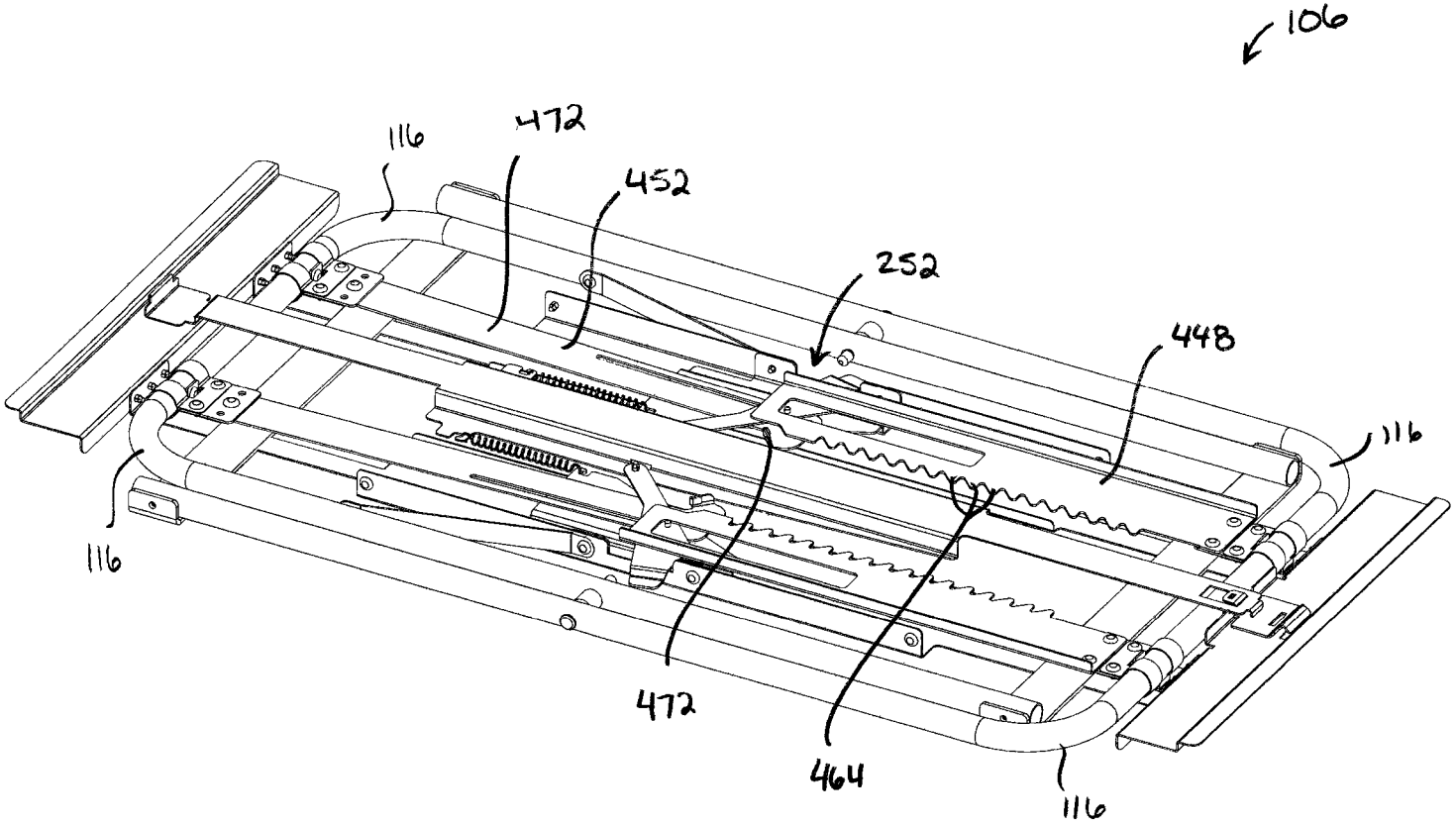
FIG. 22B is a top perspective view of the height adjustable support structure of FIG. 20 in the lowered position with the guide rail upper portion removed, and the height lock in the unlocked position.

Referring to FIG. 22A, rack 448 extends laterally from a first rack end 456 to a second rack end 460. The first rack end 456 is shown connected to first crossbeam 144. This allows rack 448 to move laterally with first crossbeam 144 as height adjustable support structure 106 moves between the raised and lowered positions. Rack 448 includes a plurality of teeth 464 arranged single file in a laterally extending row. In the illustrated example, teeth 464 face longitudinally inwardly. However, in alternative embodiments, teeth 464 may face longitudinally outwardly.

Still referring to FIG. 22A, pawl 452 includes an arm 468 and a tooth engaging bar 472 extend from the arm 468. Arm 468 extends laterally from a first pawl arm end 476 to a second pawl arm end 480. In the illustrated example, first pawl arm end 476 is connected to second crossbeam 148. This allows pawl 452 to move laterally with second crossbeam 148 as height adjustable support structure 106 moves between the raised and lowered positions. Pawl bar 472 is shown extending from second pawl arm end 480.

In the illustrated example, first pawl arm end 476 is pivotally connected to second crossbeam 148. This allows pawl bar 472 to pivot longitudinally (e.g. about a vertical axis) between an engaged position (FIG. 22A) and a disengaged position (FIG. 22B). In the engaged position (FIG. 22A), pawl bar 472 engages a rack tooth 464 to inhibit relative lateral movement between pawl 452 and rack 448. This inhibits relative lateral movement between the connected first and second crossbeams 144 and 148, and thereby locks the height position of height adjustable support structure 106. In the disengaged position (FIG. 22B), pawl bar 472 is pivoted away from rack teeth 464 to allow relative lateral movement between pawl 452 and rack 448, thereby permitting height adjustment of height adjustable support structure 106.

In the illustrated example, pawl bar 472 pivots inwardly away from rack teeth 464, and pivots outwardly into engagement with rack teeth 464. In alternative embodiments which may have a different arrangement of rack teeth 464, pawl bar 472 may pivot outwardly away from rack teeth 464 and inwardly into engagement with rack teeth 464.

Referring to FIG. 21A, height adjustable support structure 106 includes a height lock release actuator 244 that is manually user operable (e.g. by hand) to disengage pawl 452 from rack 448 and thereby allow the height position of height adjustable support structure 106 to be adjusted. Height lock release actuator 244 can take any form suitable for manual disengagement of pawl 452 from rack 448. In the illustrated embodiment, height lock release actuator 244 is a slide-switch. As shown in FIG. 17, height lock release actuator 244 is finger-accessible through a height lock release actuator opening 484 in tabletop 104.

Height lock release actuator 244 is laterally movable between a deactivated position (FIG. 21A) and an activated position (FIG. 21B) for locking and unlocking height lock 252, respectively. In the illustrated embodiment, height lock release actuator 244 is connected to a height lock bar 332 that is pulled laterally by operation of height lock release actuator 244. Height lock bar 332 is connected to height lock pawl 452 by way of a height lock pivot arm 488. As exemplified, when height lock bar 332 is moved laterally outwardly by manual user operation of height lock release actuator 244, the height lock pivot arm 488 acts on height lock pawl 452 to disengage height lock pawl 452 from height lock rack 448.

Figure 23A:
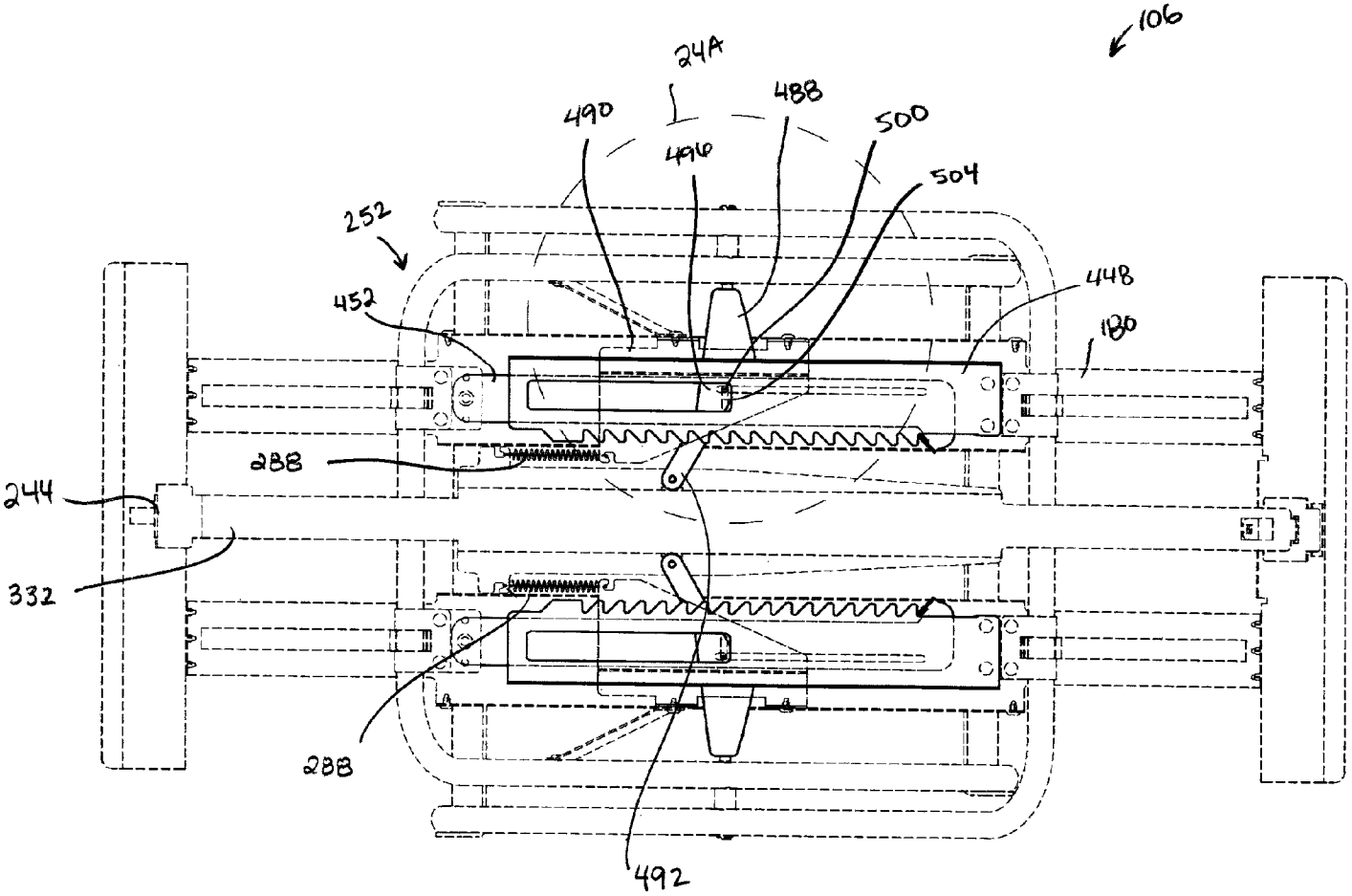
FIG. 23A is a top plan view of the height adjustable support structure of FIG. 21A.
Figure 23B:
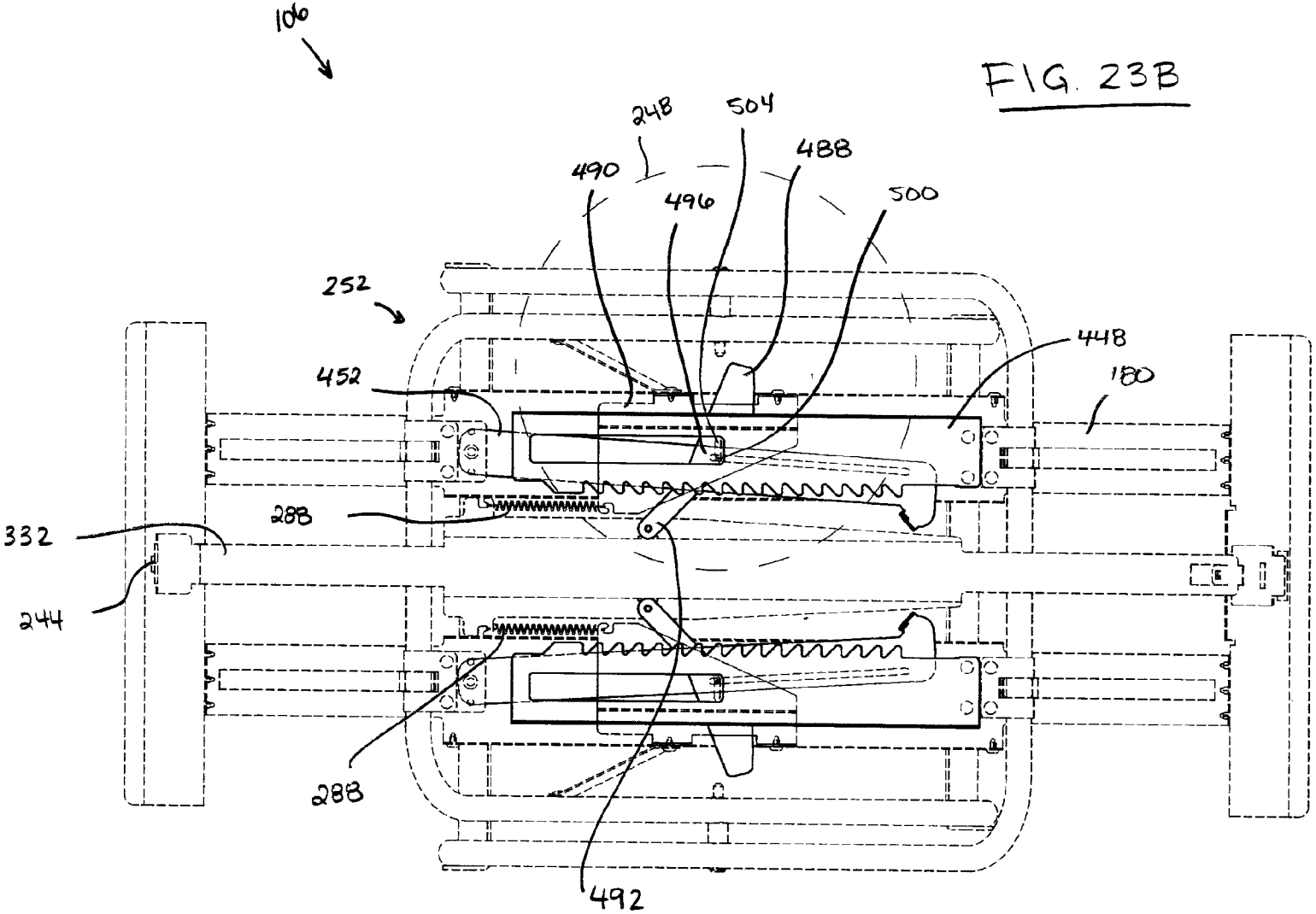
FIG. 23B is a top plan view of the height adjustable support structure of FIG. 21B.

FIGS. 23A and 23B show height lock 252 in an engaged (i.e. locked) and disengaged (i.e. unlocked) position respectively. As shown, height lock 252 includes a stationary plate 490 (roughly triangular in shape in the illustrated embodiment, although the exact shape is not important), height lock rack 448, height lock pawl 452, height lock pivot arm 488, and height lock bar 332. The stationary plate 490 may be connected to a stationary component of height adjustable support structure 106, such as a guide rail 180 as shown. Height lock pivot arm 488 includes a first pivot arm portion 492 that is pivotally attached to height lock bar 332, and which moves laterally together with height lock bar 332. Height lock pivot arm 488 also includes a second pivot arm portion 496 that is pivotally attached to a height lock pin 500. Height lock pin 500 is slideably mounted in a longitudinal slot 504 formed in stationary plate 490. As can be seen by examining FIGS. 24A and 24B, when first pivot arm portion 492 moves laterally with height lock bar 332, the second pivot arm portion 496 is caused to moved longitudinally with height lock pin 500 along stationary plate slot 504. This is a consequence of the fixed length between first and second pivot arm portions 492 and 496.

Figure 24A:
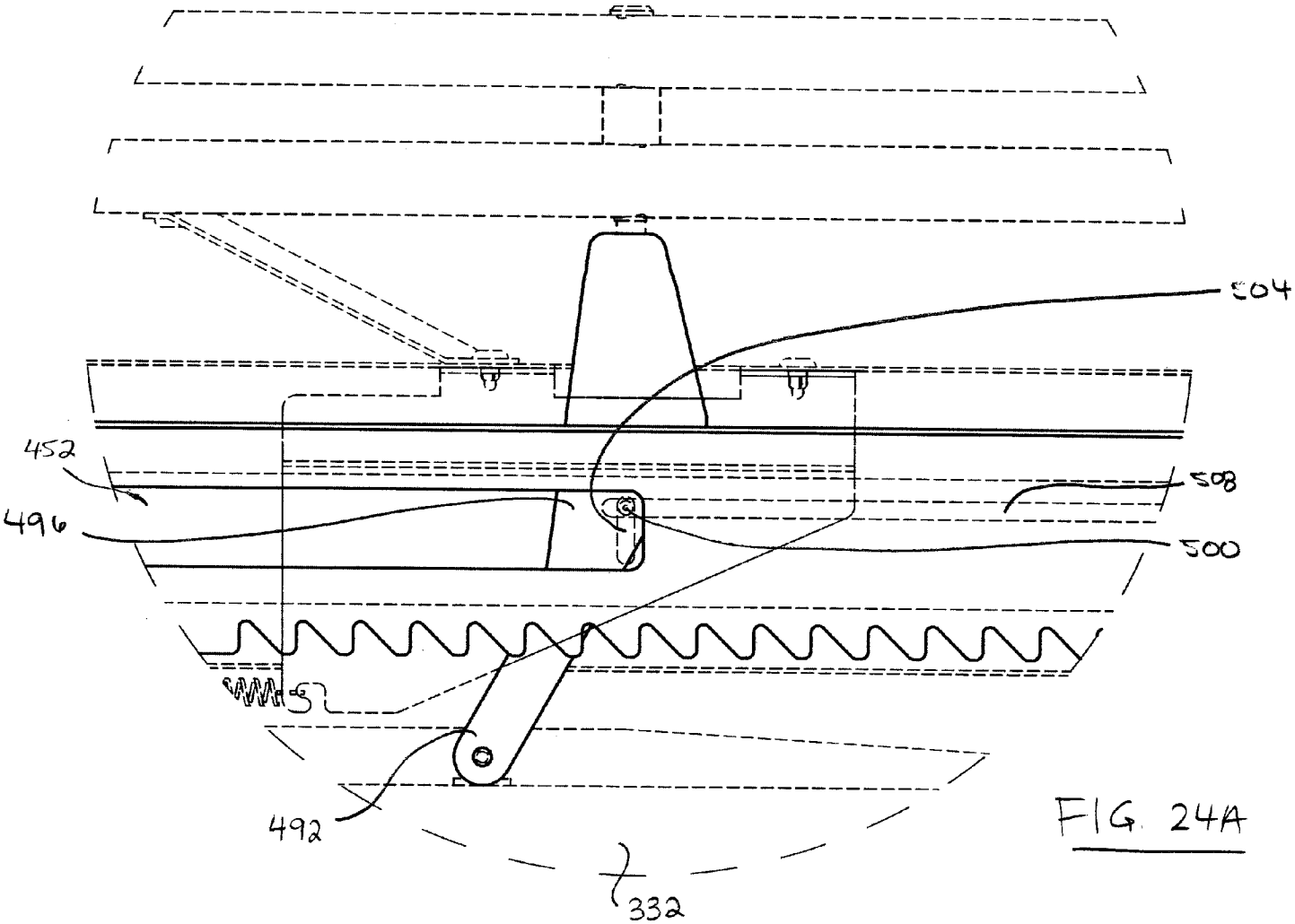
FIG. 24A is an enlarged view of region 24A in FIG. 23A.
Figure 24B:
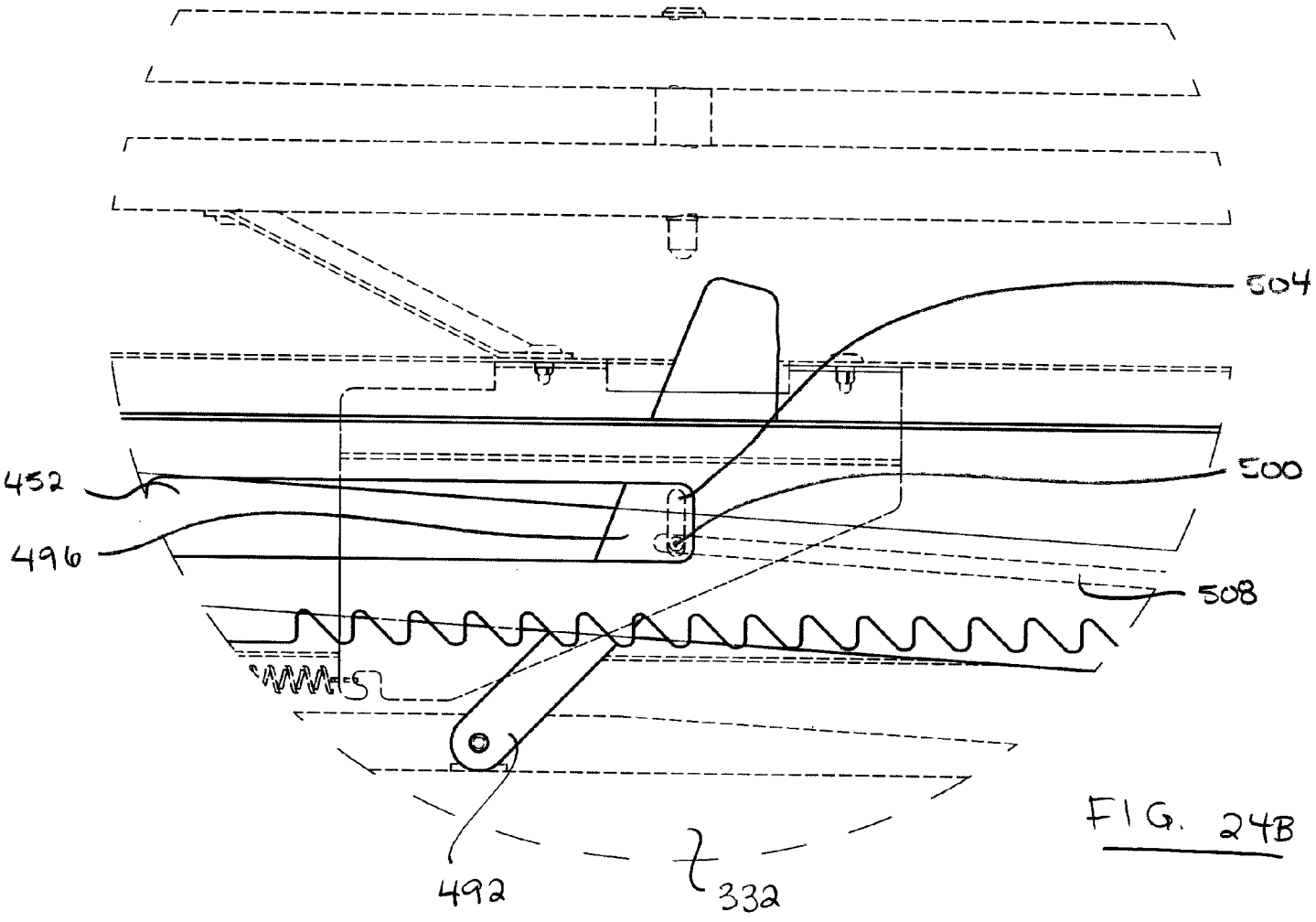
FIG. 24B is an enlarged view of region 24B in FIG. 23B.

Still referring to FIGS. 24A and 24B, height lock pin 500 is also received in a laterally extending slot 508 of height lock pawl 452. When height lock pin 500 moves longitudinally with second pivot arm portion 496, height lock pin 500 acts upon height lock pawl 452 to pivot the height lock pawl 452 between the engaged (i.e. locked, FIG. 24A) and disengaged (i.e. unlocked, FIG. 24B) positions. When height lock pawl 452 is disengaged, the height lock pin 500 is laterally slideable along pawl slot 508 as height adjustable support structure 106 is height adjusted between the raised position (FIG. 21B) and lowered position (FIG. 22B).

Returning to FIGS. 23A and 23B, height lock 252 may be biased to an engaged (i.e. locked) position. This allows a user to simply cease operating height lock release actuator 244 to allow the height lock 252 to automatically re-engage, thereby locking the height of height adjustable support structure 106 at its current height position. Height lock 252 may be biased to an engaged position in any manner. In the illustrated embodiment, height lock 252 includes a lock bias 288 (exemplified as tension springs) which is connected in tension to height lock bar 332 and stationary plate 490. In operation, the lock bias 288 applies a lateral force on height lock bar 332 to draw height lock bar 332 laterally to the engaged position. A user can manually operate height lock release actuator 244 to move height lock bar 332 laterally toward the disengaged position against the bias of lock bias 288.

Referring to FIG. 21A, height lock rack 448 is shown including a plurality of rack teeth 464, which define a plurality of engagement positions for pawl bar 472, each representing a different user selectable height position for height adjustable support structure 106. As shown in FIG. 22A, the first tooth 512 provides the lowest engagement position for pawl bar 472 where height adjustable support structure 106 is set to the lowered position. As shown in FIG. 21A, the last tooth 516 provides the highest engagement position for pawl bar 472 where height adjustable support structure 106 can be set to the raised position. In some embodiments, height lock rack 448 includes a portion 520 adjacent the first tooth 512 that is free of rack teeth 464 and engagement positions. This prevents user selection of some very low positions for height adjustable support structure 106 where the weight placed on tabletop 104 (FIG. 17) can translate to excessive stresses upon height adjustable support structure 106. Accordingly, portion 520 may help to mitigate damage to height adjustable support structure 106 from excessive stresses. Region 520 can have a lateral width 524 of two rack teeth 464 or more (e.g. two to fifty rack teeth 464).

Referring to FIG. 22A, height adjustable support structure 106 is shown including a safety 256, which when engaged prevents operation of the height lock release actuator 244 and thereby prevents height lock 252 from becoming unlocked. The safety 256 is movable between engaged and disengaged positions by manual user operation (i.e. by hand) of a safety release actuator 248. As shown in FIG. 17, safety release actuator 248 is finger-accessible through a safety release actuator opening 528 in tabletop 104.

Figure 25A:
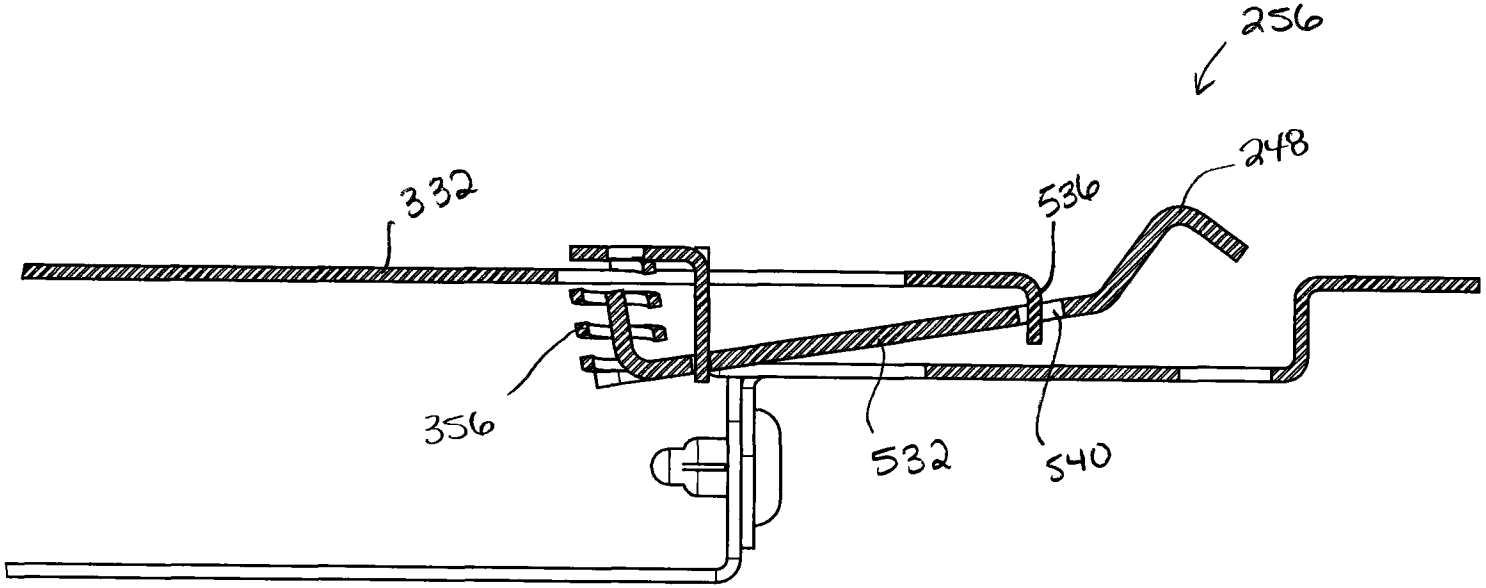
FIG. 25A is a cross-sectional view taken along line 25-25 in FIG. 22A showing a safety in an engaged position and a height lock bar in a locked position.
Figure 25B:
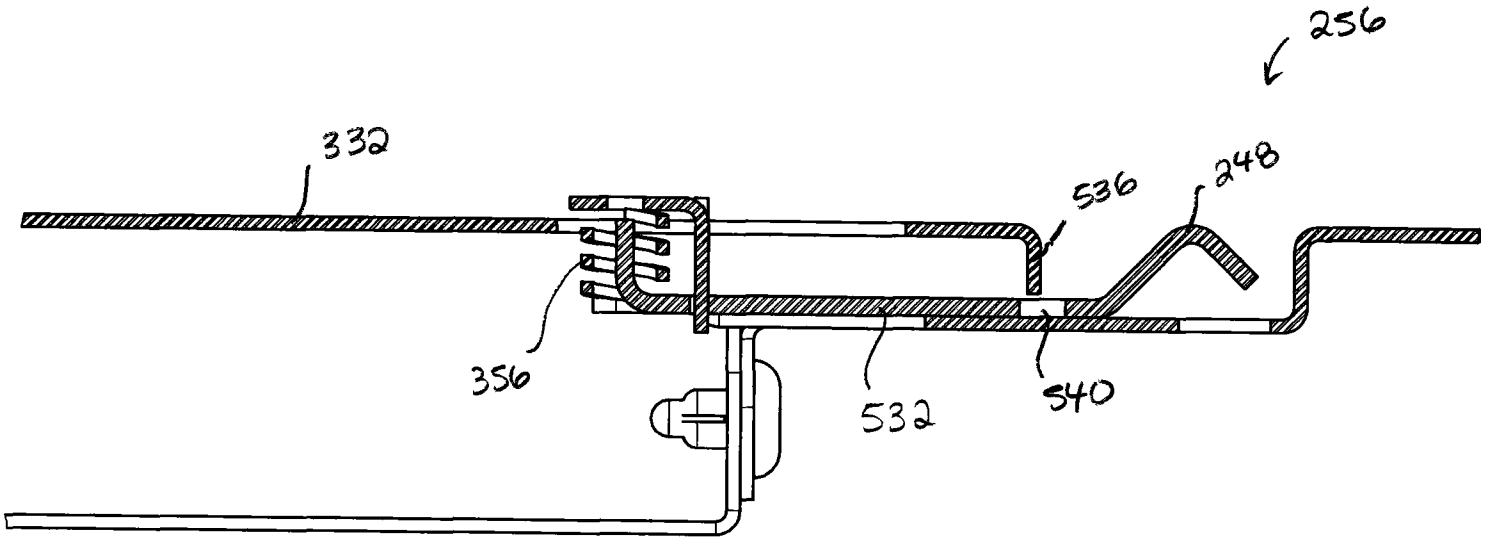
FIG. 25B is the cross-sectional view of FIG. 25A showing the safety in a disengaged position and the height lock bar in the locked position.
Figure 25C:
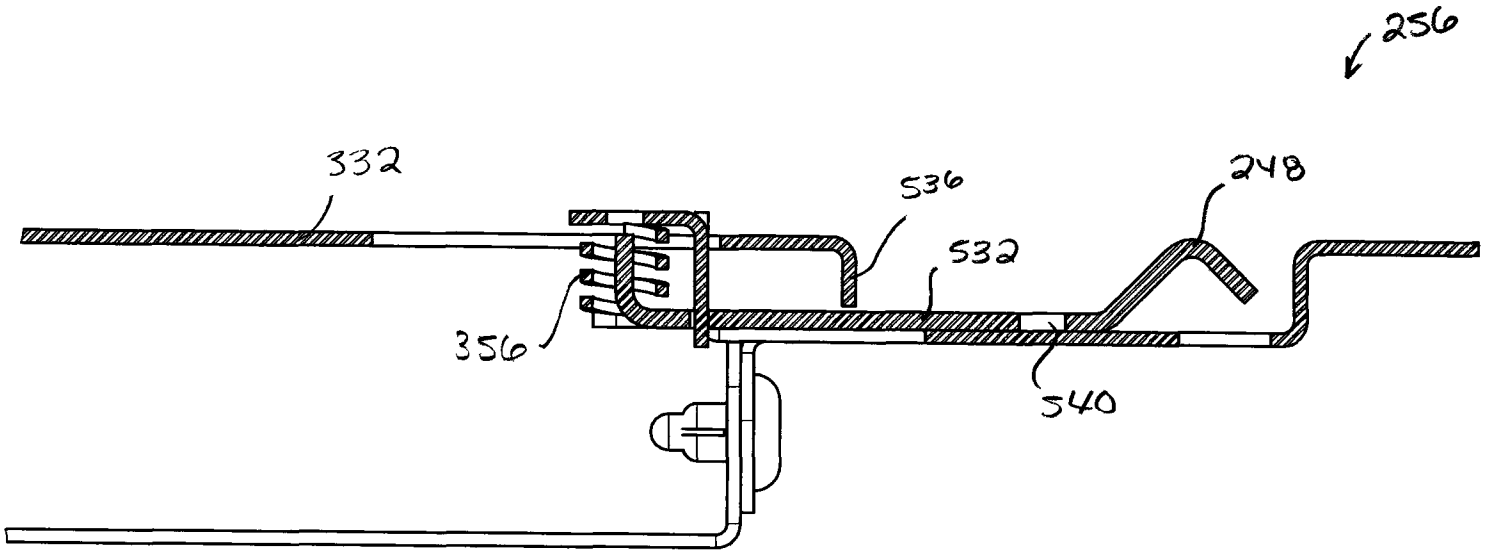
FIG. 25C is the cross-sectional view of FIG. 25A showing the safety in a disengaged position and the height lock bar in the unlocked position.

Turning now to FIGS. 25A and 25B, an exemplary safety 256 is shown in engaged and disengaged positions, respectively. As shown, safety 256 includes a safety lever 532 which is pivotable between an engaged position (FIG. 25A) and a disengaged position (FIG. 25B). In the engaged position, seen in FIG. 25A, the safety lever 532 engages height lock bar 332 to inhibit lateral movement of the height lock bar 332 to its unlocked position. In the disengaged position, seen in FIG. 25B, the safety lever 532 is disengaged from height lock bar 332 which allows height lock bar 332 to move laterally to its unlocked position as shown in FIG. 25C.

Referring to FIG. 25A, safety 256 may be releasably engageable with height lock bar 332 in any manner suitable for selectively inhibiting height lock bar 332 from moving to its unlocked position. In the illustrated embodiment, height lock bar 332 is formed with a protrusion 536 which is removably receivable in an opening 540 of safety lever 532. When safety 256 is in the engaged position, lock bar protrusion 536 extends into opening 540 which inhibits lateral movement of lock bar 332. As shown in FIG. 25B, safety lever 532 may be pivotable away from lock bar protrusion 536 to move lock bar protrusion 536 out of safety lever opening 540. As shown in FIG. 25C, this provides lock bar protrusion 536 with clearance to allow lock bar 332 to move laterally to its unlocked position.

Safety release actuator 248 may have any user operable configuration. In the illustrated embodiment, safety release actuator 248 is formed as a button which is downwardly depressable to pivot safety lever 532 away from lock bar protrusion 536.

Referring to FIG. 25A, safety 256 is shown biased to its engaged position. This allows safety 256 to re-engage automatically when a user ceases to operate safety release actuator 248 and lock bar 332 is in its locked position. Safety 256 may be biased to the engaged position in any manner. In the illustrated embodiment, safety 256 is shown including a safety release bias 356 (exemplified as a compression spring) which exerts compressive force upon safety lever 532 thereby biasing safety lever 532 to the engaged position. A user can manually depress safety-release actuator 248 against the bias of safety release bias 356 to pivot safety lever 532 to the disengaged position.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

Items

Item 1. A portable tabletop assembly comprising:

a horizontal tabletop;

first and second pairs of legs for supporting the tabletop on a horizontal surface, each pair of legs including a first leg and a second leg pivotably connected to one another, each of the first and second legs of each pair having a first leg end, and a second leg end slidably coupled to the tabletop, a first crossbeam connecting the first leg of the first pair of legs to the first leg of the second pair of legs, the first crossbeam and the second leg ends of the first legs of the first and second pairs are slidable relative to the tabletop and relative to the second leg ends of the second legs of the first and second pairs so that the tabletop moves between a raised position and a storage position; and a height lock coupled to the first pair of legs and engageable at infinite positions between the raised and storage positions to inhibit horizontal sliding of the first crossbeam and the second leg ends of the first legs of the first and second pairs to fix a height of the tabletop above the horizontal surface.

Item 2. The portable tabletop assembly of item 1, wherein: the first crossbeam and the second leg ends of the first legs of the first and second pairs of legs, and the second leg ends of the second legs of the first and second pairs of legs are slidable relative to the tabletop to move the tabletop between a raised position and a storage position.

Item 3. The portable tabletop assembly of item 2, wherein the height lock, when activated, inhibits sliding of the second leg ends relative to the tabletop.

Item 4. The portable tabletop assembly of any one of items 1-3, wherein:

the height lock, when disengaged, moves relative to a guide as the tabletop moves between the raised and storage positions.

Item 5. The portable tabletop assembly of item 4, wherein: the height lock, when activated, acts on the guide to inhibit sliding of the second leg ends relative to the tabletop.

Item 6. The portable tabletop assembly of item 4 or item 5, wherein:

the height lock slides along the guide as the tabletop moves between the raised and storage positions, and the height lock, when activated, acts on the guide to inhibit sliding of the height lock relative to the guide.

Item 7. The portable tabletop assembly of any one of items 4-6, wherein:

the crossbeam is slidable relative to the tabletop in parallel with the guide, and the height lock, when activated, applies friction to the guide to inhibit sliding of the crossbeam.

Item 8. The portable tabletop assembly of any one of items 4-7, wherein:

the guide is coupled to the second leg of the first pair for sliding relative to the tabletop in synchronicity with the second leg end of the second leg of the first pair.

Item 9. The portable tabletop assembly of any one of items 1-8, further comprising:

a second crossbeam connecting the second leg of the first pair to the second leg of the second pair, the second crossbeam and the second leg ends of the second legs of the first and second pairs are slidable relative to the tabletop and relative to the second leg ends of the first legs of the first and second pairs to move the tabletop between the raised position and the storage position Item 10. The portable tabletop assembly of item 9, when dependent on item 4, wherein:

the guide is connected to the second crossbeam so that the guide and the second crossbeam slide together relative to the tabletop.

Item 11. The portable tabletop assembly of any one of items 1-10, wherein:

the height lock is biased to engagement, and the assembly further comprises a height lock-release actuator, which when activated disengages the height lock.

Item 12. A portable tabletop assembly comprising:

a tabletop;

a height-adjustable support structure connected to the tabletop; and a height locking mechanism operably connected to the support structure, the height locking mechanism having at least one height lock, a height lock-release actuator, a safety, and a safety-release actuator, the height lock, when activated, engages with the support structure to inhibit height adjustment of the support structure, the height lock-release actuator, when activated, deactivates the height lock to permit height adjustment of the support structure, the safety, when activated, inhibits activation of the height lock-release actuator, and the safety-release actuator, when activated deactivates the safety to permit the height lock-release actuator to be activated.

Item 13. The portable tabletop assembly of item 12, wherein: the support structure comprises a first leg and a second leg, the first leg movable relative to the second leg for adjusting a height of the support structure.

Item 14. The portable tabletop assembly of item 13, wherein: the height lock, when activated, prevents relative movement between the first and second legs.

Item 15. The portable tabletop assembly of item 14, wherein: each of the first and second legs includes a first leg end, and a second leg end slidably coupled to the tabletop, the second leg ends of the first and second legs are both slidable relative to the tabletop toward and away from each other for adjusting the height of the support structure.

Item 16. The portable tabletop assembly of item 15, wherein: the height lock, when activated, inhibits sliding of the second leg ends relative to the tabletop.

Item 17. The portable tabletop assembly of item 15 or item 16, further comprising:

at least one guide operably connected to the second leg ends for constraining sliding of the second leg ends to a lateral direction.

Item 18. The portable tabletop assembly of item 17, wherein: the height lock, when activated, acts on the guide to inhibit sliding of the second leg ends relative to the tabletop.

Item 19. The portable tabletop assembly of item 18, further comprising:

a first crossbeam connected to the first leg and slidable along the guide in the lateral direction in synchronicity with the second leg end of the first leg.

Item 20. The portable tabletop assembly of item 19, wherein: the height lock, when activated, acts on the guide to inhibit sliding of the first crossbeam along the guide.

Item 21. The portable tabletop assembly of item 20, wherein: the height lock is connected to the crossbeam, and when activated applies friction to the guide to inhibit sliding of the crossbeam along the guide.

Item 22. The portable tabletop assembly of item 20 or item 21, wherein:

the guide is coupled to the second leg for sliding laterally relative to the tabletop in synchronicity with lateral sliding of the second leg end of the second leg.

Item 23. The portable tabletop assembly of item 22, further comprising:

a second crossbeam connected to the second leg and slidable in the lateral direction in synchronicity with the guide and the second leg end of the second leg.

Item 24. The portable tabletop assembly of any one of items 13-22, further comprising:

a height lock bar connected to the height lock-release actuator, activating the height lock-release actuator comprises moving the height lock bar, and the safety, when activated, acts on the height lock bar to inhibit movement of the height lock bar to inhibit activation of the height lock-release actuator.

Item 25. The portable tabletop assembly of item 24, wherein: the safety-release actuator, when activated, acts on the safety to disengage the safety from the height lock bar.

Item 26. The portable tabletop assembly of item 24 or item 25, wherein:

the safety comprises a latch which, when activated, engages the height lock bar to inhibit movement of the height lock bar to inhibit activation of the height lock-release actuator.

Item 27. The portable tabletop assembly of any one of items 13-26 when dependent on item 13, wherein:

the first leg is pivotably coupled to the second leg, the first and second legs being height adjustable to a storage position in which the first and second legs are oriented substantially parallel to the tabletop, and the portable tabletop assembly further comprises a storage lock which, when activated, retains the first and second legs in the storage position.

Item 28. The portable tabletop assembly of item 27, further comprising:

a crossbar connected at least one of the first and second legs, the storage lock, when activated, acts on the crossbar to inhibit movement of the crossbar relative to the tabletop to retain the first and second legs in the storage position.

Item 29. The portable tabletop assembly of item 28, wherein: the storage lock comprises a latch which, when activated, engages the crossbar to inhibit movement of the crossbar relative to the tabletop.

Item 30. The portable tabletop assembly of any one of items 27-29, wherein:

lock-release actuator, when activated, deactivates the storage lock to permit the first and second legs to move out of the storage position.

Item 31. The portable tabletop assembly of any one of items 12-30, wherein:

the tabletop extends laterally between first and second lateral tabletop ends, the height lock-release actuator is positioned within finger-reach of the first lateral tabletop end, and the safety-release actuator is positioned within finger-reach of the second lateral tabletop end.

Item 32. A method of adjusting the height of a portable tabletop assembly, the tabletop assembly comprising a tabletop and a height-adjustable support structure connected to the tabletop for supporting the tabletop above a horizontal surface, the tabletop extending laterally between first and second lateral tabletop ends, the method comprising:

concurrently grasping the first lateral tabletop end and activating a safety-release actuator to deactivate a safety to a height lock-release actuator, with the safety deactivated, concurrently grasping the second lateral tabletop end and activating the height lock-release actuator to permit height adjustment of the support structure, and adjusting a height of the support structure to a desired height, and then activating the height lock to fix the height of the support structure at the desired height.

Item 33. The method of item 32, wherein:

before said activating the safety-release actuator, the tabletop is retained in a storage position by an activated storage lock; and said activating the height lock-release actuator deactivates the storage lock to release the tabletop from the storage position.

Item 34. The method of item 32, wherein:

the safety-release actuator is proximate the first lateral tabletop end, and the height-lock release actuator is proximate the second lateral tabletop end.

Item 35. A portable tabletop assembly comprising:

a tabletop extending in lateral and longitudinal dimensions;

first and second pairs of legs for supporting the tabletop on a surface, each pair of legs including a first leg pivotably connected to a second leg for rotation about a longitudinal axis, and each of the first and second legs having a first leg end, and a second leg end slidably coupled to the tabletop;

a crossbar having a first end connected to the first pair of legs, and a second end connected to the second pair of legs;

a first centering arm, the first centering arm having opposite first and second arm ends, the first arm end pivotally connected to the second leg of the first pair between the first and second leg ends of the second leg of the first pair, the second arm end pivotally connected to the table top, and the first and second arm ends both positioned laterally to one side of the crossbar, in each pair, the second leg ends of the first and second legs are both slidable relative to the tabletop away from each other for pivoting the first leg relative to the second leg to lower the tabletop toward the surface from a raised position into a storage position, and in the storage position, the crossbar abuts the tabletop.

Item 36. The portable tabletop assembly of item 35, wherein the crossbar is aligned with the longitudinal axis.

Item 37. The portable tabletop assembly of item 35 or item 36, wherein:

the second leg of the first pair has a recess, and the first centering arm is received in the recess when the tabletop is in the storage position.

Item 38. The portable tabletop assembly of any one of items 35-37, wherein, in the storage position, the first and second legs are parallel with the tabletop.

Item 39. The portable tabletop assembly of any one of item 35-38, wherein:

the tabletop has a lateral width measured in the lateral direction;

in each pair, each second leg end is slidable in the lateral direction toward and away from the other second leg end; and a length of each leg, measured from the first leg end to the second leg end of that leg, is less than or equal to the lateral width of the tabletop.

Item 40. The portable tabletop assembly of any one of items 35-39, wherein:

in the storage position, the second leg end of each leg is positioned inboard a periphery of the tabletop.

Item 41. The portable tabletop assembly of any one of items 35-40, wherein in the storage position, the first and second leg ends of each leg abuts the tabletop.

Item 42. The portable tabletop assembly of any one of items 35-41, wherein:

a bottom end of the tabletop includes at least one leg recess, and in the storage position, the first and second legs of each pair are received in a leg recess of the at least one leg recess.

Item 43. The portable tabletop assembly of any one of items 35-42, wherein:

the tabletop has a thickness, and in the storage position, a thickness of the portable tabletop assembly is less than a sum of the thickness of the tabletop and a thickness of one of the legs.

Item 44. A portable tabletop assembly, comprising:

a tabletop defining a support surface, the tabletop having opposite first and second lateral ends;

a height adjustable support structure coupled to the tabletop for supporting the tabletop;

a height lock coupled to the height adjustable support structure, the height lock when activated inhibiting height adjustment of the height adjustable support structure;

a height lock-release actuator coupled to the tabletop, the height lock-release actuator when activated deactivates the height lock to permit height adjustment of the height adjustable support structure;

a safety coupled to the tabletop, the safety when activated inhibiting activation of the height-lock release actuator;

a safety-release actuator coupled to the tabletop, the safety-release actuator when activated deactivates the safety to permit activation of the height-lock release actuator;

wherein the height lock-release actuator is positioned proximate the first lateral end of the tabletop for manual actuation while grasping the first lateral end, and the safety-release actuator is positioned proximate the second lateral end of the tabletop for manual actuation while grasping the second lateral end.

The invention claimed is:

1. A portable tabletop assembly comprising:

a tabletop;

a height-adjustable support structure connected to the tabletop, the support structure having a movable support structure portion; and a height locking mechanism operably connected to the support structure, the height locking mechanism having at least one height lock, a height lock-release actuator, a safety, and a safety-release actuator, the height lock, when activated, inhibits movement of the movable support structure portion and thereby inhibits height adjustment of the support structure, the height lock-release actuator having a movable lock-release portion, the when activated, frees the movable support structure portion to move and thereby deactivates the height lock to permit height adjustment of the support structure, the safety, when activated, inhibits movement of the movable lock-release portion, and thereby inhibits activation of the height lock-release actuator, and the safety-release actuator, when activated, frees the movable lock-release portion to move and thereby deactivates the safety to permit the height lock-release actuator to be activated.

2. The portable tabletop assembly of claim 1, wherein:

the movable support structure portion comprises a first leg and a second leg, the first leg movable relative to the second leg for adjusting a height of the support structure.

3. The portable tabletop assembly of claim 2, wherein:

the height lock, when activated, prevents relative movement between the first and second legs.

4. The portable tabletop assembly of claim 3, wherein:

each of the first and second legs includes a first leg end, and a second leg end slidably coupled to the tabletop, the second leg ends of the first and second legs are both slidable relative to the tabletop toward and away from each other for adjusting the height of the support structure.

5. The portable tabletop assembly of claim 4, wherein:

the height lock, when activated, inhibits sliding of the second leg ends relative to the tabletop.

6. The portable tabletop assembly of claim 4, further comprising:

at least one guide operably connected to the second leg ends for constraining sliding of the second leg ends to a lateral direction.

7. The portable tabletop assembly of claim 1, further comprising:

a height lock bar connected to the height lock-release actuator, activating the height lock-release actuator comprises moving the height lock bar, and the safety, when activated, acts on the height lock bar to inhibit movement of the height lock bar to inhibit activation of the height lock-release actuator.

8. The portable tabletop assembly of claim 7, wherein:

the safety-release actuator, when activated, acts on the safety to disengage the safety from the height lock bar.

9. The portable tabletop assembly of claim 7, wherein:

the safety comprises a latch which, when activated, engages the height lock bar to inhibit movement of the height lock bar to inhibit activation of the height lock-release actuator.

10. The portable tabletop assembly of claim 1, wherein:

the tabletop extends laterally between first and second lateral tabletop ends, the height lock-release actuator is positioned within finger-reach of the first lateral tabletop end, and the safety-release actuator is positioned within finger-reach of the second lateral tabletop end.

11. A method of adjusting the height of a portable tabletop assembly, the tabletop assembly comprising a tabletop, a height-adjustable support structure connected to the tabletop for supporting the tabletop above a horizontal surface, and a height locking mechanism, the height locking mechanism having a height lock, a height lock-release actuator, a safety, and a safety-release actuator, the tabletop extending laterally between first and second lateral tabletop ends, the method comprising:

concurrently grasping the first lateral tabletop end and activating the safety-release actuator to deactivate the safety to the height lock-release actuator thereby permitting activation of the height lock-release actuator, with the safety deactivated, concurrently grasping the second lateral tabletop end and activating the height lock-release actuator to deactivate the height lock thereby permitting height adjustment of the support structure, and adjusting a height of the support structure to a desired height, and then reactivating the height lock to fix the height of the support structure at the desired height.

12. The method of claim 11, wherein:

the safety-release actuator is proximate the first lateral tabletop end, and the height-lock release actuator is proximate the second lateral tabletop end.

13. A portable tabletop assembly, comprising:

a tabletop defining a support surface, the tabletop having opposite first and second lateral ends;

a height adjustable support structure coupled to the tabletop for supporting the tabletop, the support structure having a movable support structure portion;

a height lock coupled to the height adjustable support structure, the height lock when activated inhibiting movement of the movable support structure portion and thereby inhibiting height adjustment of the height adjustable support structure;

a height lock-release actuator coupled to the tabletop and having a movable lock-release portion, the height lock-release actuator when activated frees the movable support structure portion to move and thereby deactivates the height lock to permit height adjustment of the height adjustable support structure;

a safety coupled to the tabletop, the safety when activated inhibiting movement of the movable lock-release portion, and thereby inhibiting activation of the height-lock release actuator;

a safety-release actuator coupled to the tabletop, the safety-release actuator when activated frees the movable lock-release portion to move and thereby deactivates the safety to permit activation of the height-lock release actuator;

wherein the height lock-release actuator is positioned proximate the first lateral end of the tabletop for manual actuation while grasping the first lateral end, and the safety-release actuator is positioned proximate the second lateral end of the tabletop for manual actuation while grasping the second lateral end.

* * * * *